US005255053A

United States Patent [19]

Green et al.

[11] Patent Number: 5,255,053

[45] Date of Patent: Oct. 19, 1993

[54] IMAGE FORMING APPARATUS HAVING A TRANSFER DRUM, AN IMAGE MEMBER CARTRIDGE AND EXPOSURE MEANS

[75] Inventors: Michael H. Green, Rochester; John M. Beres, Hilton, both of N.Y.

[73] Assignee: Eastman Kodak Company, Rochester, N.Y.

[21] Appl. No.: 985,472

[22] Filed: Dec. 3, 1992

[51] Int. Cl.[5] ..... G03G 15/00

[52] U.S. Cl. ..... 355/200; 355/210; 355/271

[58] Field of Search ..... 355/200, 210, 211, 271; 346/108, 139 R

[56] References Cited

U.S. PATENT DOCUMENTS 3,966,316 6/1976 Pfeifer et al. ..... 355/200

5,138,372 8/1992 DeCecca ..... 355/200

*Primary Examiner*—Joan H. Pendegrass

*Attorney, Agent, or Firm*—Leonard W. Treash, Jr.

[57] ABSTRACT

Image forming apparatus includes a laser and a laser chassis. An image member cartridge containing a photoconductive drum is receivable in the laser chassis and fixed with respect to the laser. The laser chassis and image member cartridge are movable as a unit toward a transfer drum to engage the photoconductive drum and the transfer drum. Positioning surfaces engage opposite ends of a shaft of the photoconductive drum to control positioning of the drums.

8 Claims, 24 Drawing Sheets

IMAGE FORMING APPARATUS HAVING A TRANSFER DRUM, AN IMAGE MEMBER CARTRIDGE AND EXPOSURE MEANS

This invention relates to an image forming apparatus in which the image member is supplied in an image member cartridge and which apparatus includes an exposure means, for example, a laser and a transfer drum.

U.S. Pat. No. 5,138,372, issued Aug. 11, 1992 to DeCecca, shows an image forming apparatus having a photoconductive drum which is supplied to the apparatus in a photoconductive drum cartridge. The drum has a shaft about which the drum is rotatable, which shaft has opposite ends which extend beyond the walls of the cartridge. To accurately position the photoconductive drum in the apparatus with respect to a transfer drum, an over-center spring engages the rear of the cartridge and urges the cartridge toward the transfer drum. A pair of surfaces that are fixed with respect to the transfer drum engage the opposite ends of the photoconductive drum shaft to guide the cartridge when it is urged by the over-center spring. This device maintains the axes of rotation of the photoconductive drum and the transfer drum parallel.

The DeCecca patent suggests exposure of the photoconductive drum by a laser, but no mechanism is shown for mounting the laser with respect to the drum. It is known in the laser printer art, in general, to carefully mount a photoconductive drum cartridge with respect to a laser. Thus, the housing which receives the laser also includes bearing surfaces for controlling position of a received photoconductive drum cartridge.

SUMMARY OF THE INVENTION

It is an object of the invention to precisely mount an image member drum receivable in an image forming apparatus in a cartridge with respect to both an exposure device and a transfer drum.

These and other objects are accomplished by an image forming apparatus which includes a transfer drum, an exposure means and a chassis for mounting the exposure means. The chassis includes means for receiving an image member cartridge with the image member in such a received cartridge fixed with respect to the exposure means. Means for supporting the chassis in the image forming apparatus permits movement of the chassis with respect to the transfer drum. The image forming apparatus further includes means for urging the chassis toward the transfer drum to cause engagement of the image member in the image member cartridge with the transfer drum.

According to a preferred embodiment, the exposure means is a laser and the chassis is a laser chassis for receiving the laser. A spring urges the laser chassis toward the transfer drum. A pair of surfaces are generally horizontally positioned and engage opposite ends of the shaft of the photoconductive drum of a received cartridge to control the movement of the laser chassis toward the transfer drum to maintain the axes of rotation of the drums parallel when the drums are engaged.

With this invention, the photoconductive drum is first positioned accurately with respect to the laser and then the laser and photoconductive drum are moved as a unit to a position in which the photoconductive drum is accurately positioned with respect to the transfer drum. An untrained operator can load a photoconductive drum cartridge in the apparatus and assure proper positioning of the key components.

DESCRIPTION OF THE PREFERRED EMBODIMENTS

Figure 1:
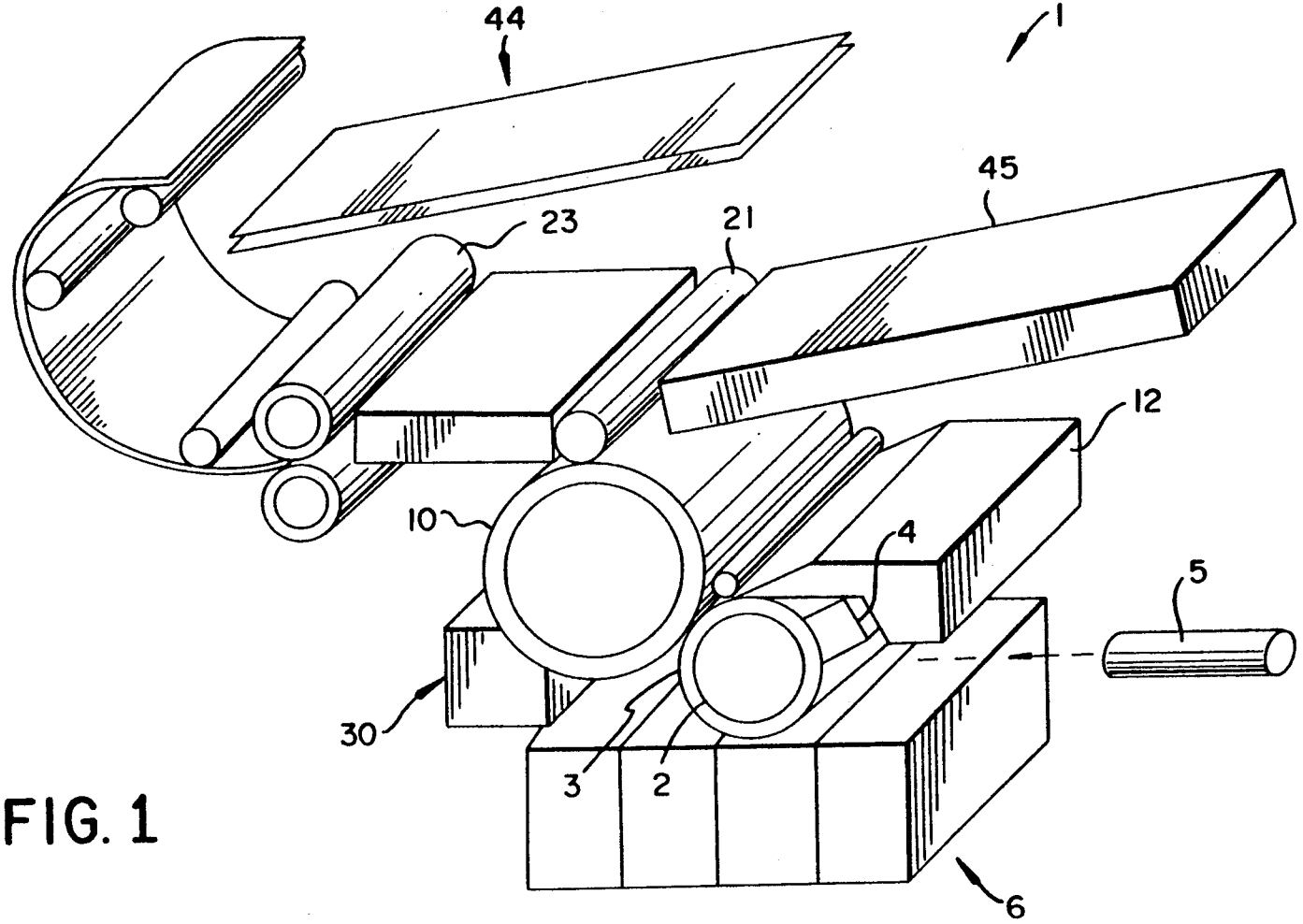
FIG. 1 is a perspective schematic of an image forming apparatus with many parts and all housing eliminated for clarity of illustration.

The invention is particularly usable in an image forming apparatus, for example, a desktop color printer 1 shown schematically in FIG. 1. Printer 1 includes an image member, for example, a photoconductive drum 2 which is journaled for rotation through operative relation with a series of stations including a charging station 4 which lays down a uniform charge on an outer cylindrical image surface 3 of image member 2. The uniformly charged image surface 3 is imagewise exposed by an electronic exposure device, for example, a laser 5 to form a series of electrostatic images.

The electrostatic images are toned by applying toners of different colors by a development device 6 to create a series of different color toner images on image surface 3. The different color toner images are transferred in registration to the outside surface of a transfer drum 10 to form a multicolor image as transfer drum 10 repeatedly rotates through transfer relation with photoconductive drum 2.

The multicolor toner image on the surface of transfer drum 10 is transferred to a receiving sheet fed from a receiving sheet supply 45 into transfer relation with drum 10 at a transfer station 21. The receiving sheet is then fed to a fuser 23. The multicolor image is fused to the receiver sheet by the application of heat and pressure. The receiving sheet with fixed multicolor toner image thereon is then conveyed through an inverting path to an output hopper already containing other receiving sheets, as shown at 44. The transfer drum 10 is cleaned by articulatable cleaner 30 after the transfer of the multicolor image. The photoconductive drum 2 is continuously cleaned by an image member cleaning device 12.

As will be described in more detail, development device 6 includes four toning stations, each containing a different color toner. Device 6 is moved horizontally to sequentially present the stations to image member 2 to apply the different toners to the images at a single development position. As also will be described in more detail, to easily replace the photoconductive drum 2, charging device 4 and cleaning device 12, they are all included in an image member cartridge, also shown in more detail below.

Figure 2:
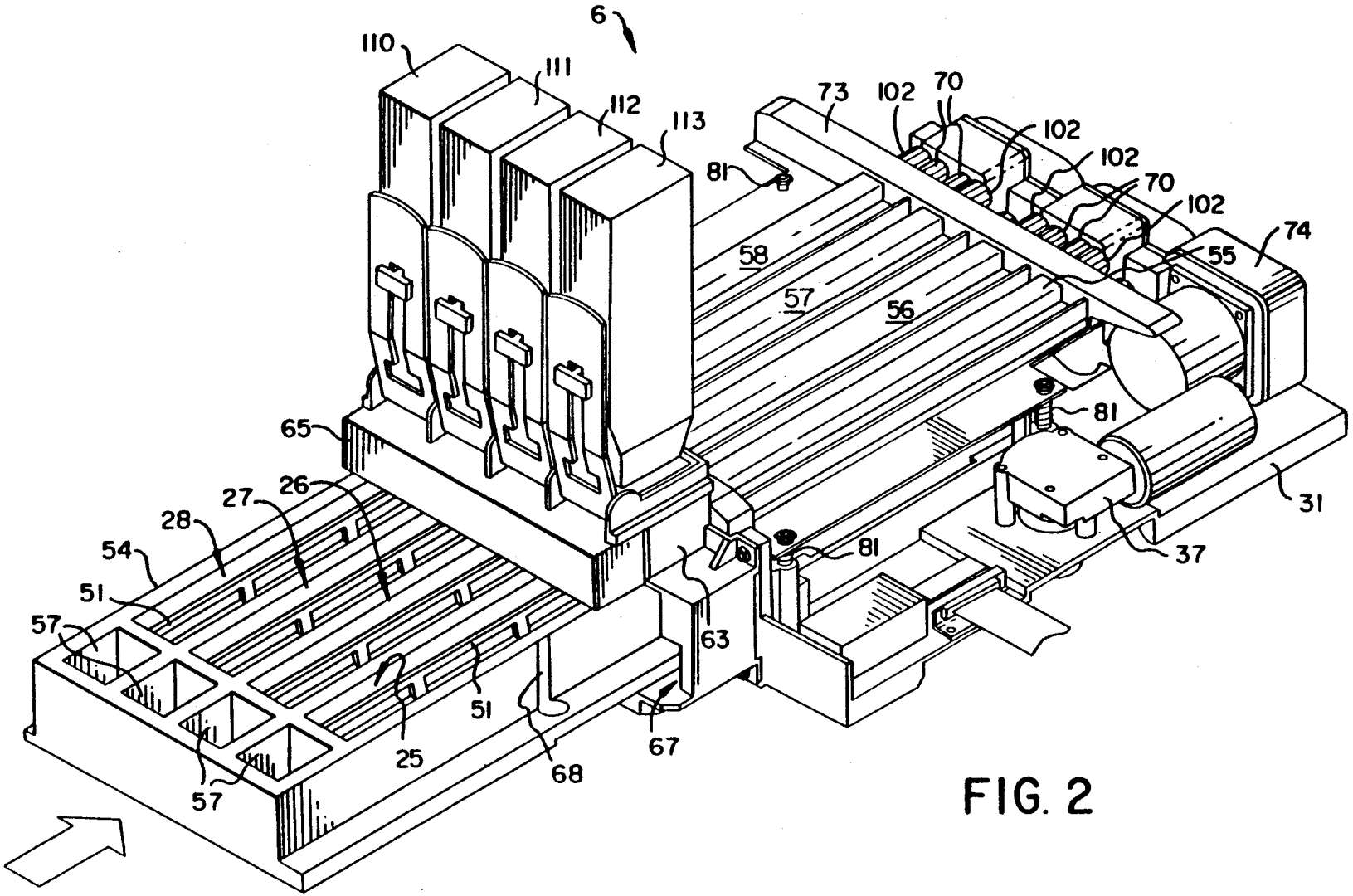
FIGS. 2 and 3 are perspective views of a development device.
Figure 3:
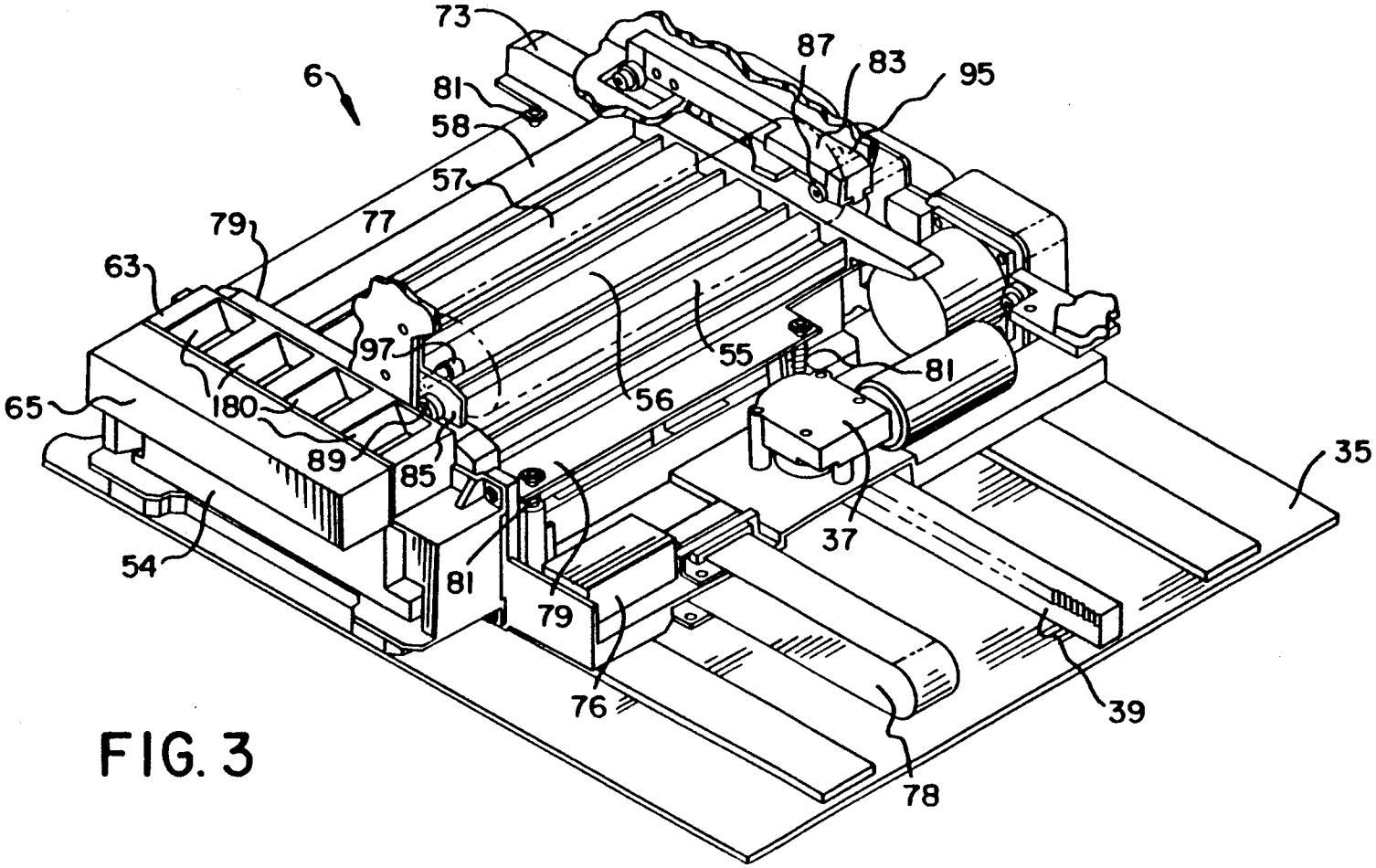
Figure 4:
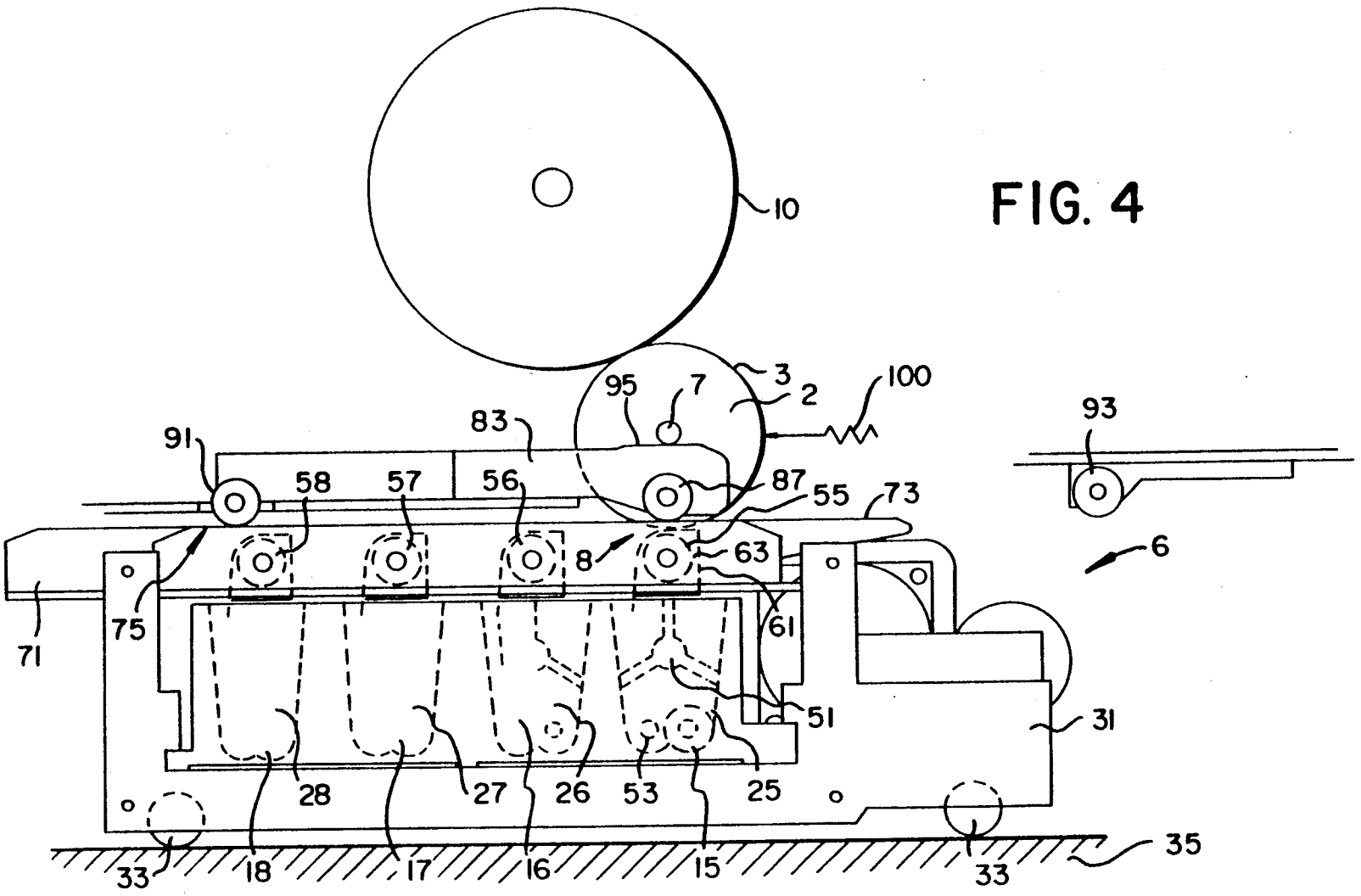
FIG. 4 is a front view of the development device with many parts eliminated and some cooperating structure included.

The development device 6 and its operation is shown in FIGS. 2-7. Referring first to FIG. 4, development device 6 includes a carriage 31 supported by wheels 33 which rest on a floor 35 for transverse movement under photoconductive drum 2. The carriage 31 is driven by a transverse drive motor 37 (FIGS. 2 and 3) which drives a pinion (not shown) engaging a rack 39 on floor 35, as shown in FIG. 3. Guide wheels, not shown, engage opposite sides of rails integral with the rack to maintain accurate straight-line transverse movement of carriage 31.

Carriage 31 support four developing units 15, 16, 17 and 18 (FIG. 4). Each developing unit 15, 16, 17 and 18 includes a sump 25, 26, 27 and 28 and an applicator 55, 56, 57 and 58, respectively. As seen with respect to unit 15 in FIG. 4, sump 25 includes a rotatable paddle 51 and a pair of augers 53 which are geared together to mix developer in the sump. The applicator 55 includes a stationary shell 61 and a rotatable magnetic core 63 inside the shell.

This type of developing unit is well known in the art. Briefly, a developer comprising a mixture of hard magnetic carrier particles and toner in sump 25 is moved around shell 61 by the rotation of magnetic core 63 to bring the developer through a development position 8 between the top of shell 61 and the image surface 3 of photoconductive drum 2. The shell 61 and the image surface 3 must be accurately spaced for high quality development of an electrostatic image carried by image surface 3. The developer is continually mixed and made available to applicator 55 by rotation of paddle 51 and augers 53.

Movement of carriage 31 from left to right, as shown in FIG. 4, indexes the development units 15, 16, 17 and 18 through the development position 8 to apply toner to develop a series of electrostatic images on image surface 3 with different color toners. The different color toner images, as previously described, are superposed in registration on transfer drum 10 to create a multicolor image.

As seen in FIG. 2, sumps 25, 26, 27 and 28, together with their paddles 51 and augers 53, comprise a single sump component 54 which is integrally formed and separately removable from carriage 31. Sump component 54 can be made of a unitary plastic construction which defines the sumps themselves, and also defines extended portions 59. Extended portions 59 do not fit under the applicators 55-58. The paddles 51 are mounted for rotation within the sumps 25-28 while the augers 53 in the bottom of the sumps extend into extended portions 59. Conventional toner replenishers 63 (shown in FIGS. 2, 3 and 7) are positioned to be directly over the extended portions 59 when the sumps are in their operative position. Replenishers 63 are driven by replenisher motors, shown covered by a replenisher motor cover 65, to meter toner under the force of gravity down onto the augers 53 in extended portions 59 on demand by the apparatus. Toner is received in the replenishers 63 from toner bottles 110, 111, 112 and 113 whose function will be described in more detail with respect to FIGS. 19-25.

Figure 5:
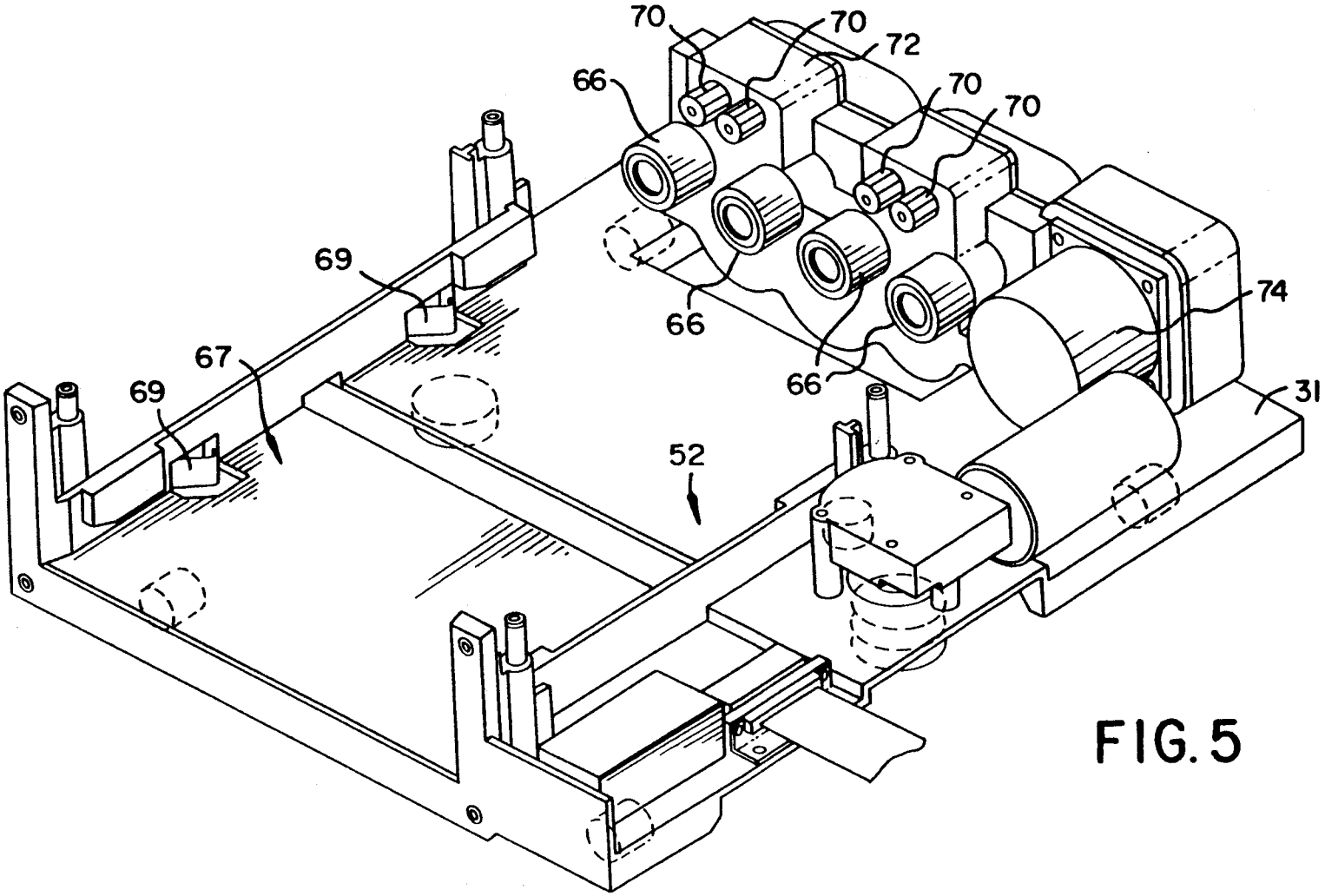
FIG. 5 is a perspective view of the bottom frame of the development device illustrating a nest for a sump component shown in FIG. 2.

As described above, the sumps 25, 26, 27 and 28 contain developer which is a mixture of carrier and toner. The toner is used up in the developing process and is replenished from the toner bottles by replenisher 63. Thus, new toner is constantly being mixed with the developer in the sumps. However, after a certain amount of use, for example 25,000-50,000 images, the carrier loses its effectiveness and must be replaced. In a high volume copier, this is commonly accomplished by a serviceperson in a periodic service call. However, in a desktop printer, such a replacement must be made by a relatively untrained operator. This is accomplished by entirely replacing sump component 54 periodically. That is, sump component is slid into and out of a nest 67 under the applicators and the replenisher. The applicators and replenisher are permanent parts of development device 6. Nest 67 is best seen in FIG. 5, which also shows a pair of springs 69 which urge sump component 54 against an opposite wall 52 of the nest 67 to releasably hold sump component 54.

Thus, sump component 54 is a single unitary component which includes the sumps for all four development units and an extended portion for receiving toner, as well as inexpensive plastic paddles and augers, and is replaceable periodically to replace the carrier in the development device. The much more expensive and critically positioned applicators and toner replenishers are permanent in the apparatus.

When the sump component 54 is moved fully into the nest 67, an engageable coupling on the leading end of sump component 54 engages four engageable drives 66 at the rear of nest 67, which drives the paddles and augers. Two embodiments of such drives will be explained more fully below.

Figure 6:
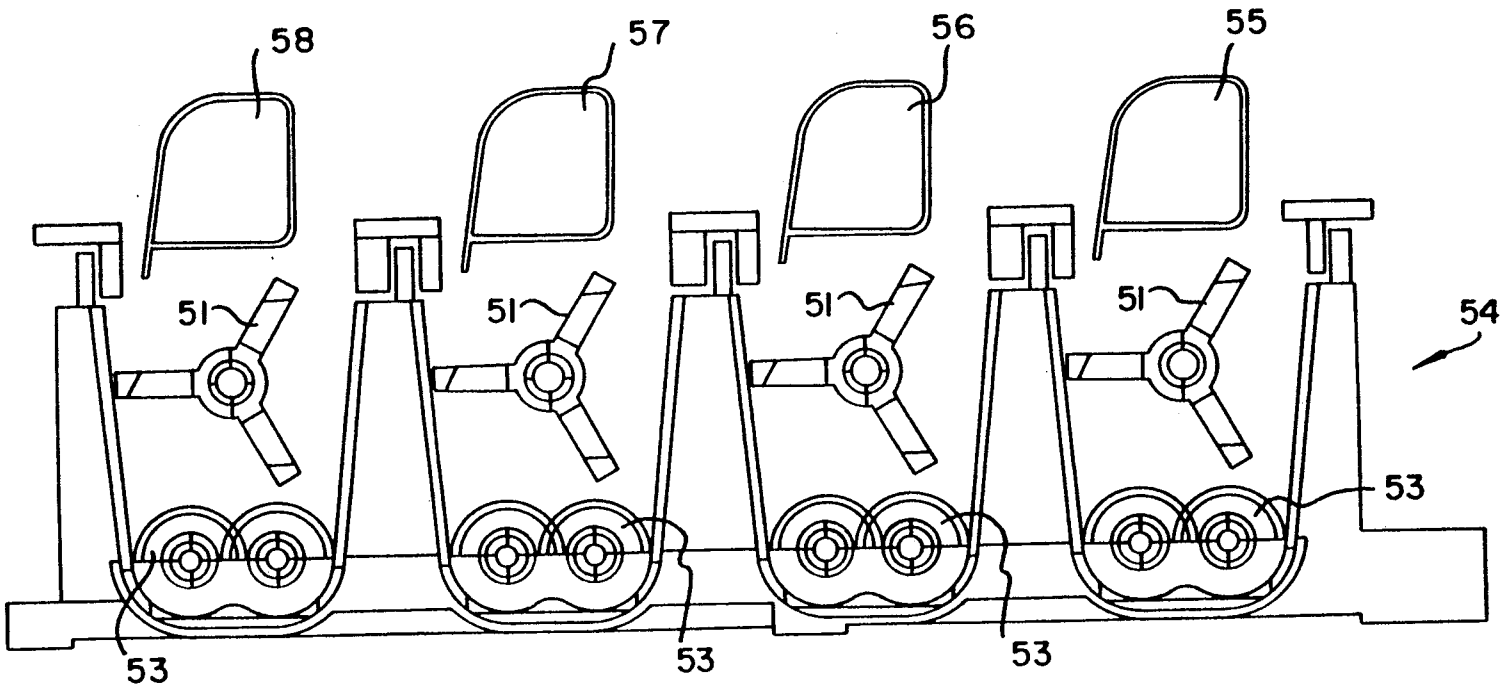
FIG. 6 is a schematic front section of the sump component showing its relationship with four applicators.
Figure 7:
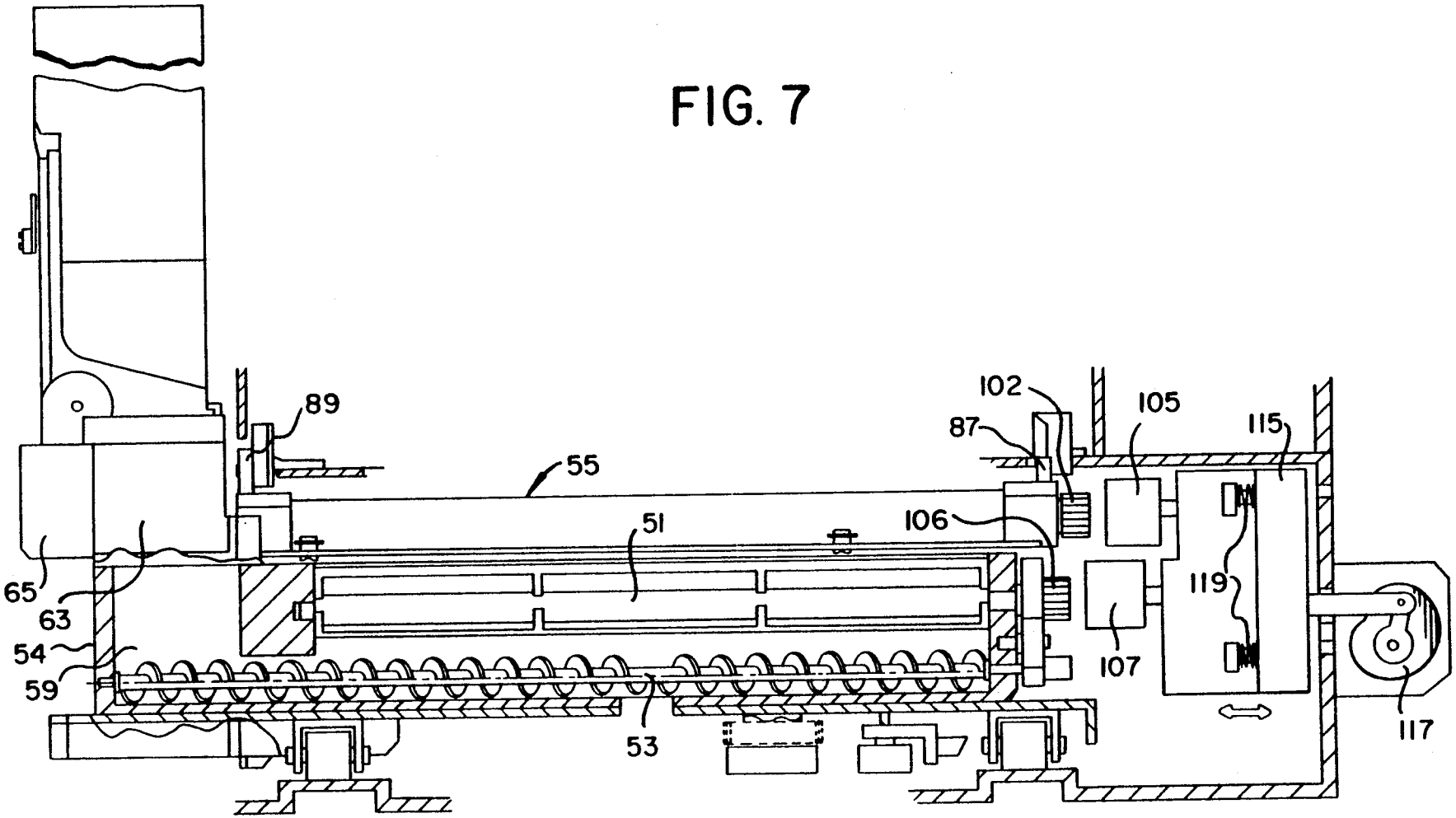
FIG. 7 is a right side view with portions in section of the development device.

FIG. 6 is a schematic front section of the sump component 54 and showing its relationship with the applicators 55-58. FIG. 7 is a side section which illustrates the relationship between the toner containers 113, the replenisher 63 and the extended portion 59 of sump component 54.

As mentioned above, vertical positioning of the applicators 55, 56, 57 and 58, with respect to the image surface 3 of photoconductive drum 2 at the development position 8, is critical to consistent development of the electrostatic images on surface 3. Accuracy in this vertical spacing in apparatus in which the photoconductive drum 2 is received in a cartridge and in which the development units 15, 16, 17 and 18 are constantly being indexed into and out of position, is challenging. This is further complicated by a desire not to directly engage drum 2 or its cartridge with moving applicators or their supports because any jar to the drum 2 or its cartridge will affect accurate exposure by laser 5 and cause image defects.

Referring primarily to FIGS. 3 and 4, the applicators 55, 56, 57 and 58 are fixed as part of an applicator component 71 which includes all four applicators, a first rail 73, a second rail 75, separators 77 and a support 79 fixing the applicators, rails and separators permanently with respect to each other. The applicator component 71 is gimbaled to the carriage 31 by three spring and pin assemblies 81 shown in FIGS. 2 and 3. The springs urge the applicator component in an upward direction to a point at which they support its weight. A first positioning member 83 and a second positioning member 85 are permanently mounted in printer 1 and firmly located with respect to transfer drum 10. A first wheel 87 is mounted on first positioning member 83 just above the desired development position 8. A second wheel 89 is mounted to second positioning member 85 and is positioned just above the opposite end of the development position 8. The first and second rollers ride on first and second rails 73 and 75, respectively, and accurately space each applicator vertically when it reaches the development position. A third roller 91 and a fourth roller 93 are positioned to alternatively engage first rail 73 to prevent rail 73 and thereby applicator component 71 from deviating from a horizontal orientation. Rail 73 is longer than the distance between first roller 87 and either third roller 91 or fourth roller 93 but is shorter than the distance between third roller 91 and fourth roller 93 so that it never contacts more than one of third roller 91 and fourth roller 93. Thus, the first and second rollers accurately control the vertical positioning of the applicator at the toning position while one of the third and fourth rollers maintains horizontal orientation of the applicator component 71. FIG. 7 also illustrates the first and second rollers 87 and 89 and the first and second rails 73 and 75 in spacing applicator 55 from photoconductive drum 2.

The first and second positioning members 83 and 85 contain first and second horizontal positioning surfaces 95 and 97 on their upper side. Photoconductive drum 2 includes a shaft 7 with opposite ends extending beyond the drum 2. The photoconductive drum 2 is urged to the left by a suitable spring, described in more detail below, but shown schematically in FIG. 4 at 100. This urging of the photoconductive drum 2 to the left causes the ends of shaft 7 to engage the positioning surfaces 95 and 97 with the photoconductive drum 2 essentially wedged between transfer drum 10 and the positioning surfaces 95 and 97. Positioning surfaces 95 and 97 are horizontal and are accurately located with respect to each other and with respect to transfer drum 10.

This construction allows accurate vertical positioning of the image surface 3 of photoconductive drum 2 with respect to an applicator at the development position 8 as well as maintaining the axes of rotation of drums 10 and 2 parallel with each other. Drum 2 is loaded in the apparatus in a cartridge. Horizontal positioning, that is, positioning from left to right, is not tightly controlled. However, if the top of the applicators 55–58 are relatively flat, as shown, horizontal positioning is much less critical than vertical spacing. Horizontal positioning is, of course, also affected by accuracy in the transversing drive of carriage 31. Control of the transversing drive is best accomplished by suitable sensors, for example, optical sensors (not shown) associated with each of the developing units.

FIGS. 2 and 5 illustrate a first embodiment of the drives for the applicators, paddles and augers. The paddle and augers for each developing unit are geared together at the rear end of each unit. A paddle shaft 106 extends from the rear of the sump component 54 with gearing that is part of sump component 54. Complete insertion of the sump component 54 by the operator into the sump component nest 67 couples the paddle shaft with a paddle drive 66, shown in FIG. 5.

The magnetic core 63 of each of the applicators 55–56 also includes an applicator shaft 102 which extends to the rear of applicator component 71 and first rail 73. The applicator shafts 102 engage drive gears 70 on their sides, as shown in FIG. 2. The applicator shafts move slightly along the sides of the gears 70 to accommodate for any vertical movement of the applicator component 71. Drives 66 and 70 are connected into a gear box 72 driven by a motor 74, all of which is carried by carriage 31.

FIG. 7 illustrates an alternate and generally preferred drive mechanism for the applicators and the paddles and augers. More specifically, each applicator shaft 102 is couplable to a single applicator drive 105. The paddle shaft 106 is couplable with a single paddle drive 107. The applicator drive 105 and the paddle drive 107 and a drive box 115 containing a motor are mounted together as a drive unit and are positioned to the rear of the development position, as seen in FIG. 7. This drive unit does not move with the carriage 31 but is movable from the rear toward the front to engage the applicator shaft and paddle shaft of the developing unit positioned at the development position. A solenoid 117 is actuable to move the drive unit toward the front in timed relation with the arrival of a developing unit at the development position. Before the developing unit is moved away from the development position, the solenoid is deactivated to permit the drive unit to move to the rear under the urging of a springs 119. Thus, the apparatus has single drives and a motor which is engageable with each of the development units without the separate drives and expensive gear box shown in FIG. 2. This is superior to the embodiment shown in FIG. 2 in weight, expense and in the noise produced. A third coupling approach would be to employ two solenoids, each engaging the two drive couplings separately or together, while the drive mechanism and motor remain stationary. This embodiment permits continual mixing of the developers in developing units when not developing and also provides the capability of removing developer from the applicator shell just before disengagement and indexing. The FIG. 2 embodiment is somewhat faster, not requiring the time needed for engaging and disengaging.

FIGS. 8–14 together with FIG. 4 illustrate the mounting of the photoconductive drum 2 in printer 1. U.S. Pat. No. 5,138,372, issued Aug. 11, 1992 to DeCecca, is incorporated by reference herein. It shows the mounting of a photoconductive drum cartridge with respect to a transfer drum by use of an over-center spring which pushes the rear of the cartridge toward the transfer drum. Opposite ends of the shaft of the photoconductive drum extend outside of the cartridge and ride on a pair of upwardly angled surfaces that are fixed with respect to the transfer drum to assure that the axes of rotation of the two drums are maintained parallel when engaged. The cartridge is supported by a single additional support toward the rear of one side of the cartridge. Thus, the cartridge in this prior apparatus is supported by opposite ends of the shaft and this rear support providing the necessary positioning and support without being overconstrained. The precise vertical position of the photoconductive drum is not determined.

Figure 14:
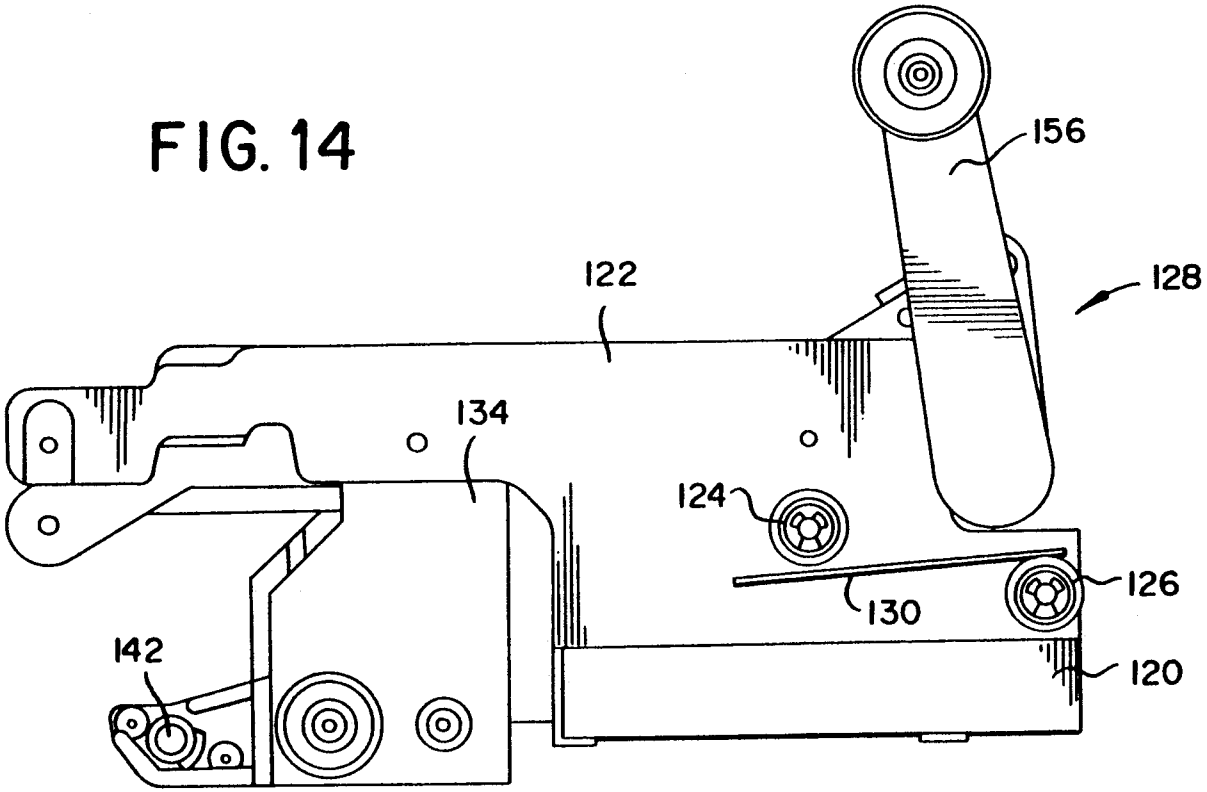
FIG. 14 is a front view of the laser chassis without the photoconductive drum cartridge.

However, it is critical that the photoconductive drum not only be mounted accurately with respect to the development stations and the transfer drum, but also with respect to an exposing device, for example, the laser 5. To accomplish this, as seen in FIG. 14, the laser 5 is mounted in a laser housing 120 which, in turn, is mounted in a laser chassis 122. On opposite sides of laser chassis 122 are a pair of rollers 124 which engage the top of a guide plate 130 and a pair of rollers 126 which engage the bottom of the guide plate 130 when the laser chassis is in the retracted position shown in FIG. 14. The chassis is also connected to the mechanism plates of the apparatus through an over-center spring mechanism 128 which is shown in FIG. 14 with the laser chassis in its retracted position and in FIGS. 8–13 in its operative, extended position.

Figure 10:
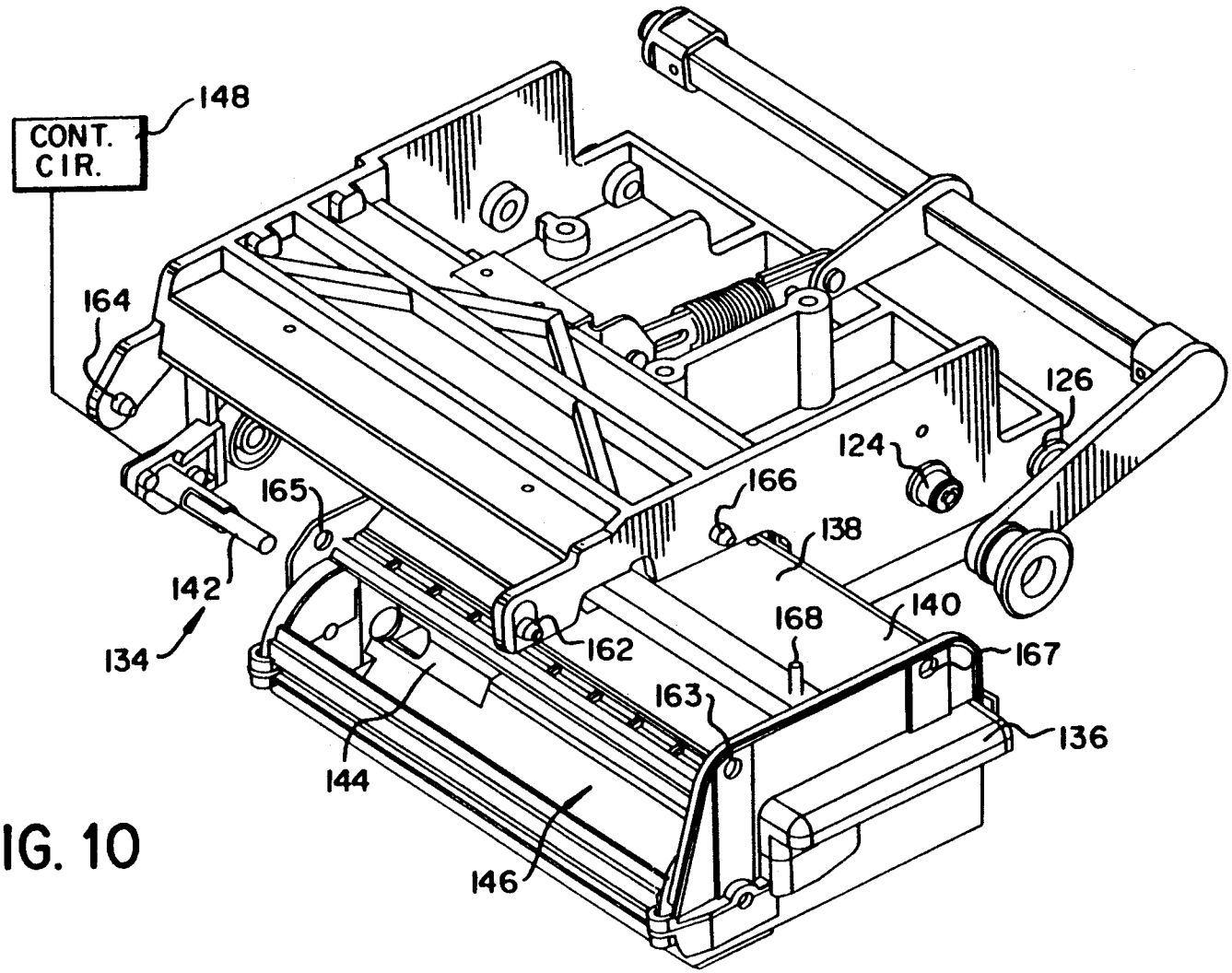
FIGS. 10, 11, 12 and 13 are perspective views of the laser chassis and the photoconductive drum cartridge.
Figure 11:
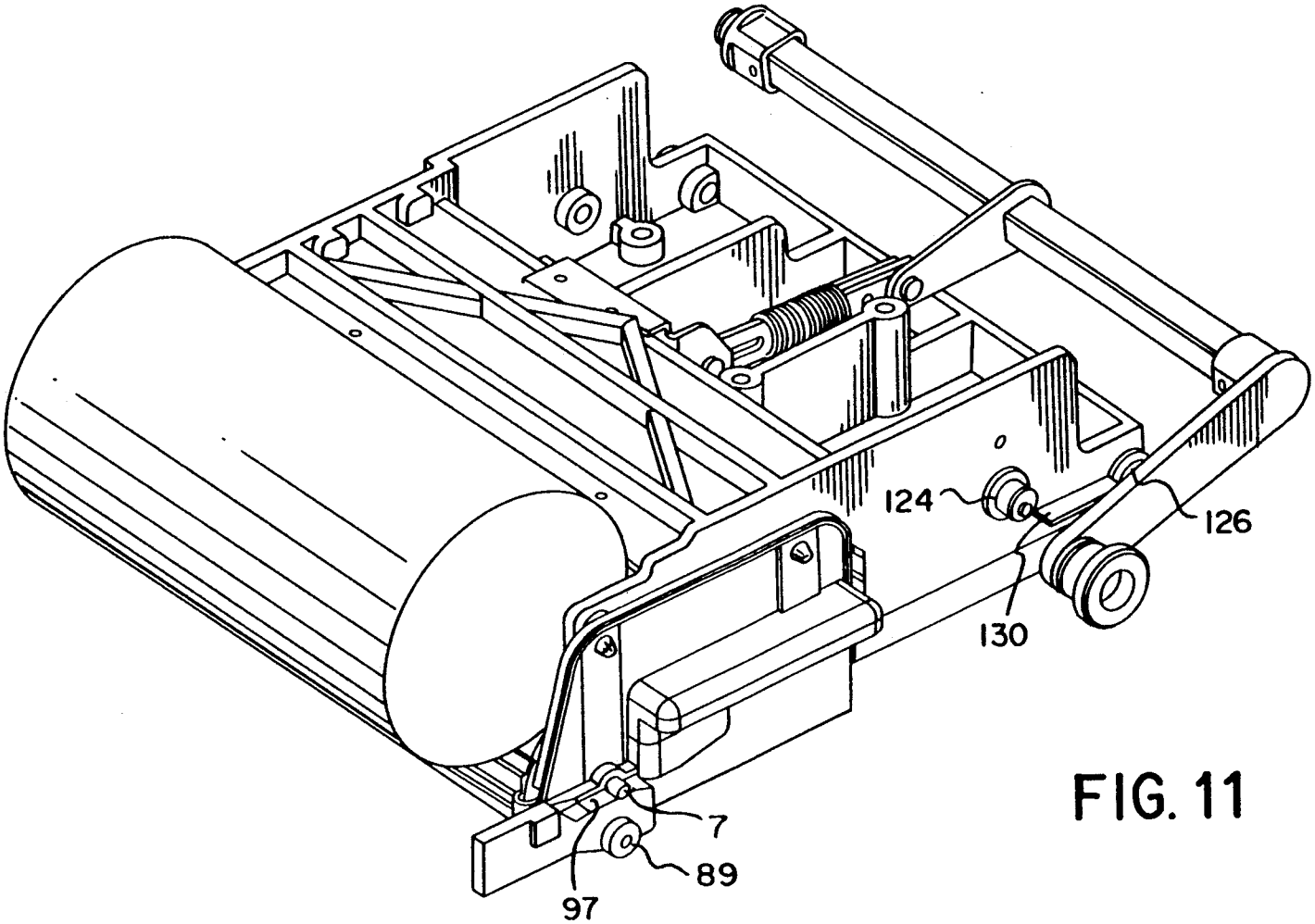

Also as shown in FIGS. 10 and 14, laser chassis 122 has a photoconductive drum cartridge nest 134. As best illustrated in FIG. 10, nest 134 receives a photoconductive drum cartridge 140 as the cartridge is slid from front to rear in a direction generally parallel to the axis of rotation of photoconductive drum 2. The cartridge is removable by grasping a handle 136 and moving it from rear to front. Insertion of the cartridge is done with the laser chassis 122 in the retracted position shown in FIG. 14. Photoconductive drum cartridge 140 includes a housing 138 which is shown in section in FIG. 15 and which protects the photoconductive drum 2. Housing 138 also defines an opening 144 (FIG. 10) which receives an electrometer 142 when the cartridge is fully inserted in chassis 122. The electrometer 142 fits in opening 144 to be positioned precisely with respect to photoconductive drum 2. Electrometer 142 is connected to a process control circuit 148 to assist in the controlling of the electrophotographic process of the printer 1. Process control circuit 148 is shown more specifically in FIG. 16 and will be discussed later.

Cartridge housing 138 also defines an opening 146 through which photoconductive drum 2 engages transfer drum 10 and an opening 152 (see FIG. 12) through which the photoconductive drum 2 is engaged by the developments units, described above. An opening 150 is elongated back toward the laser 5 and is positioned for exposure of the photoconductive drum 2 by the laser 5. Both of openings 146 and 152 can be closed by covers when the cartridge is outside of chassis 122 to protect the image surface 3. The covers can be openable by suitable cams or lugs, not shown, as part of the inserting process.

Figure 12:
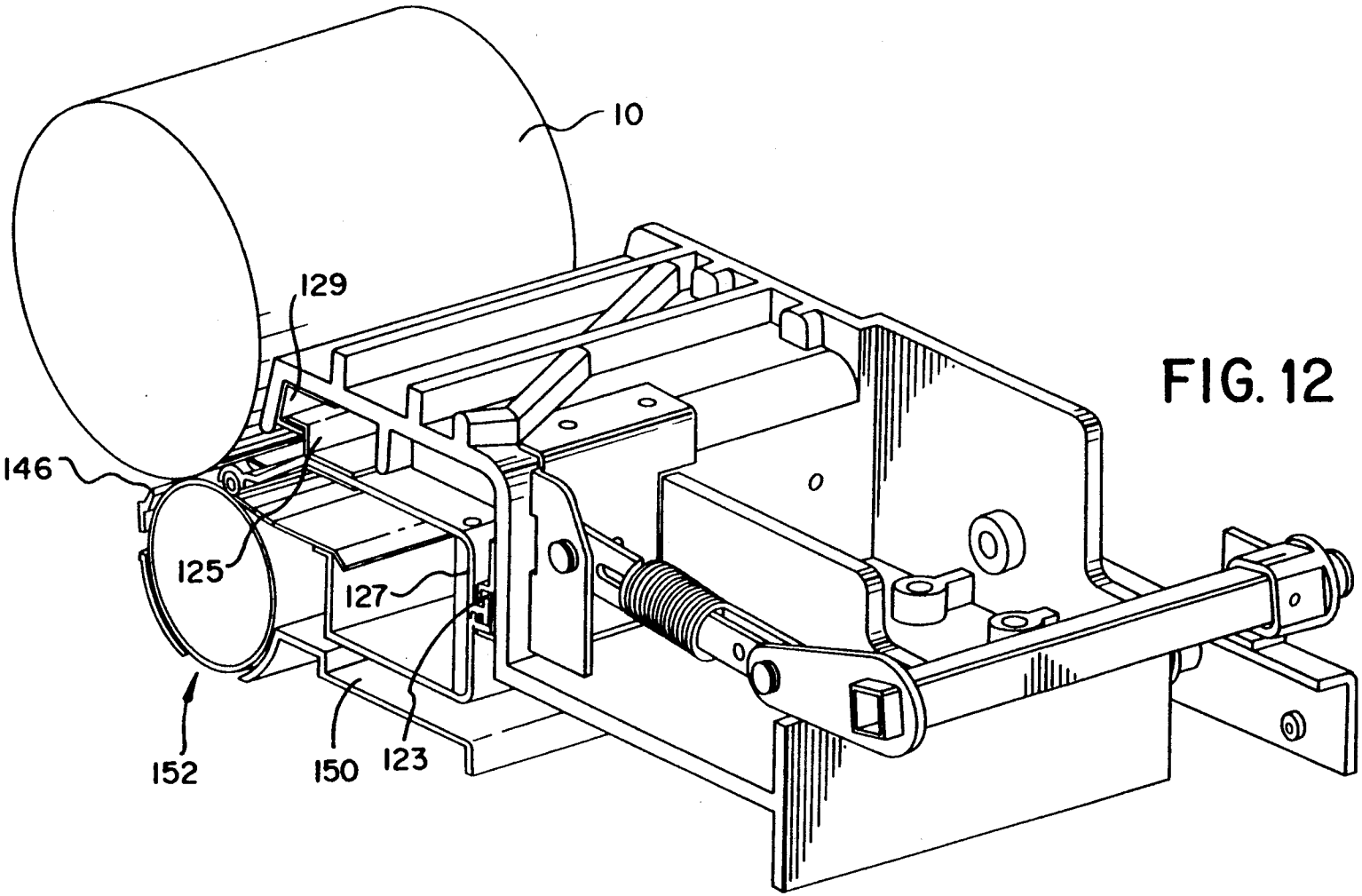
Figure 13:
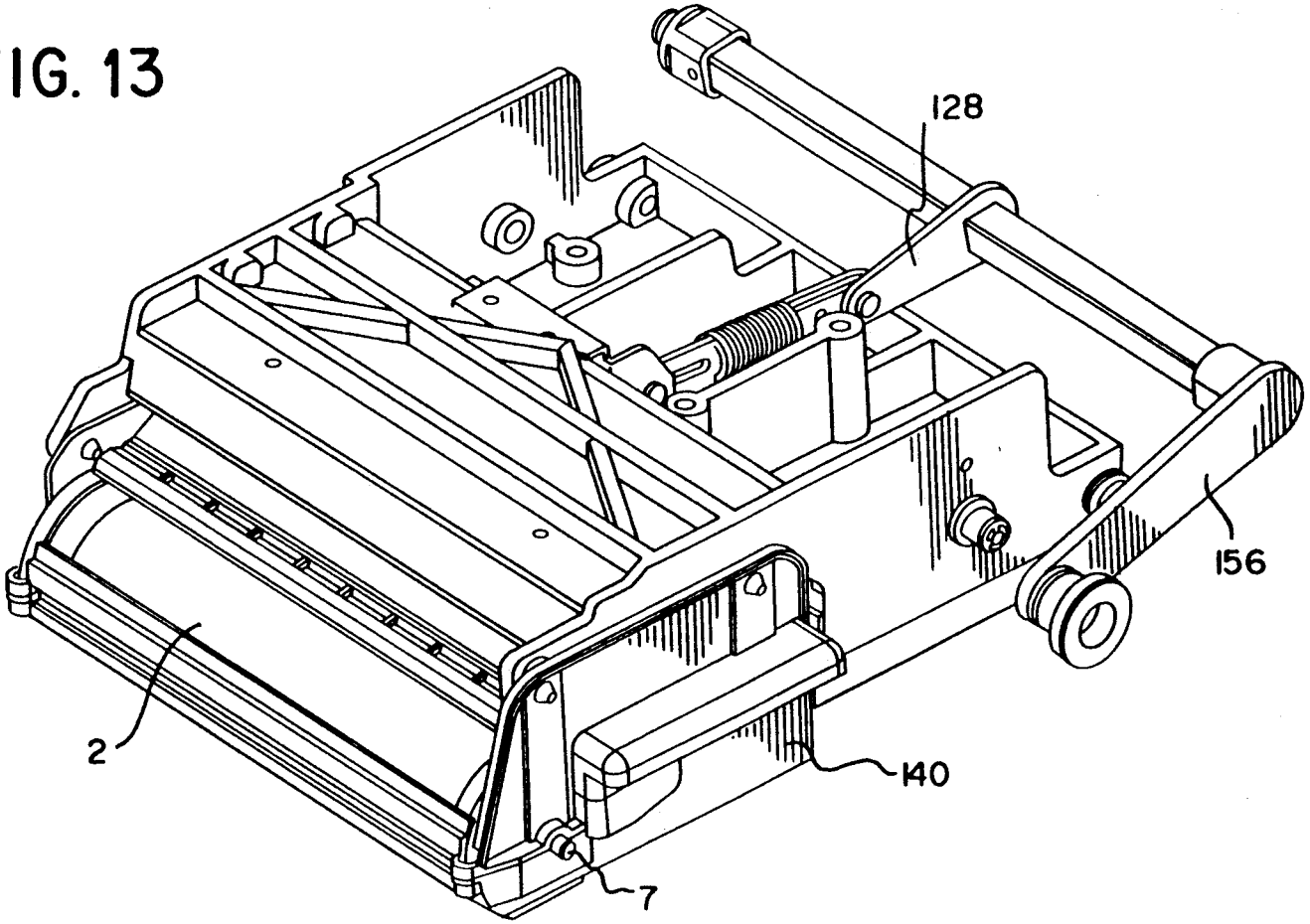
Figure 15:
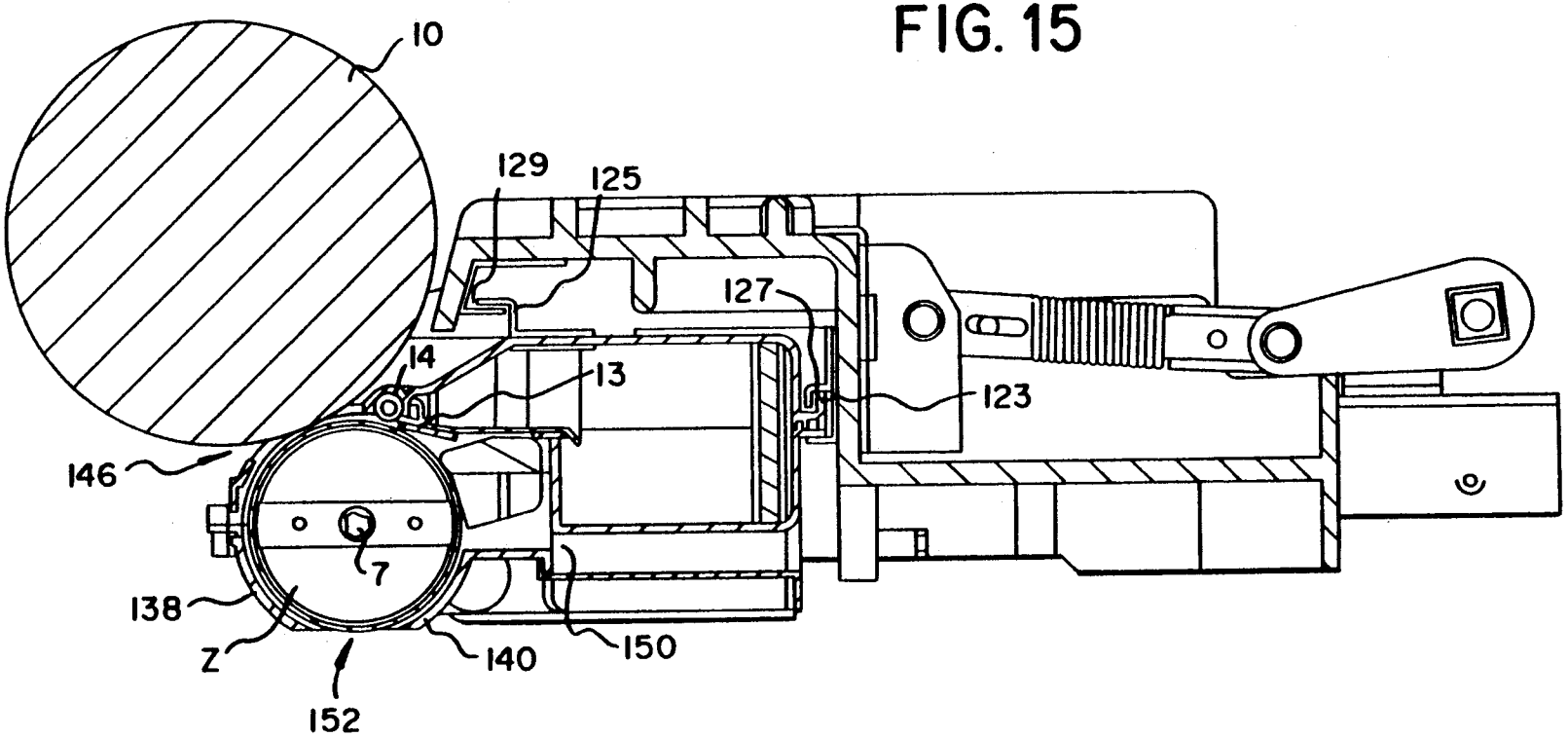
FIG. 15 is a front section of a laser chassis and the photoconductive drum cartridge.

Insertion of photoconductive drum cartridge 140 into laser chassis 122 is guided by a pair of rails 123 and 125 which fit in grooves 127 and 129, respectively, as shown in FIGS. 12 and 15. The rails and grooves guide the insertion of the cartridge accurately enough to assure that electrometer 142 enters electrometer opening 144. As seen in FIG. 10, as the cartridge is finally seated in chassis 122, front and rear left pins 162 and 164 and a right pin 166 on the laser chassis enter seating holes 163, 165 and 167 in the cartridge 140. The pins 162, 164 and 166 are bullet shaped to assure entry despite some looseness between the grooves and rails. Pins 162 and 164 are sized to snugly fit into openings 163 and 165 to firmly position cartridge 140 with respect to laser chassis 122. Opening 167 is somewhat larger horizontally that pin 166 to allow the final positioning of the cartridge to be controlled with respect to transfer drum 10, as will be described. An overridable latch (not shown) on the top of nest 134 engages a catch pin 168 to hold the cartridge in the chassis 122.

Figure 8:
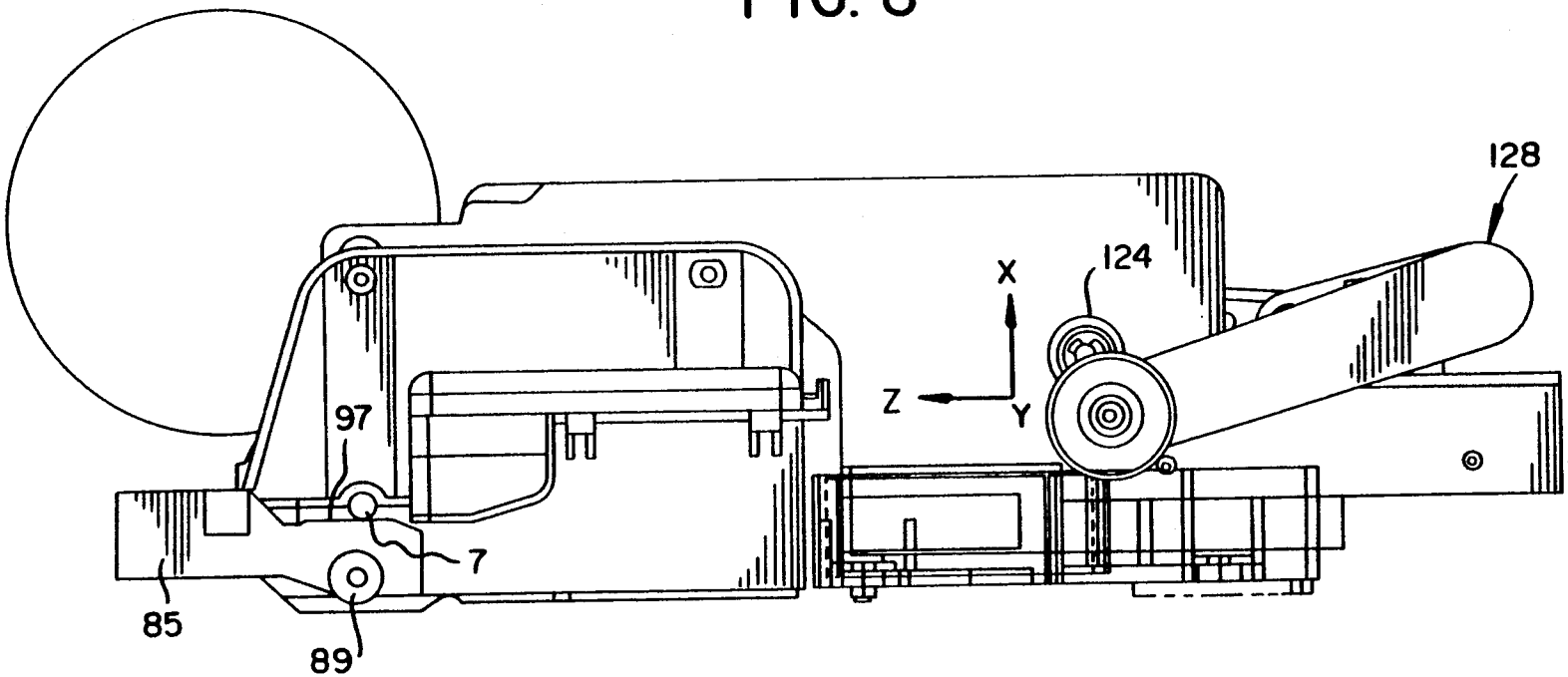
FIGS. 8 and 9 are front and back views, respectively, of a laser chassis with a photoconductive drum cartridge inserted in it.
Figure 9:
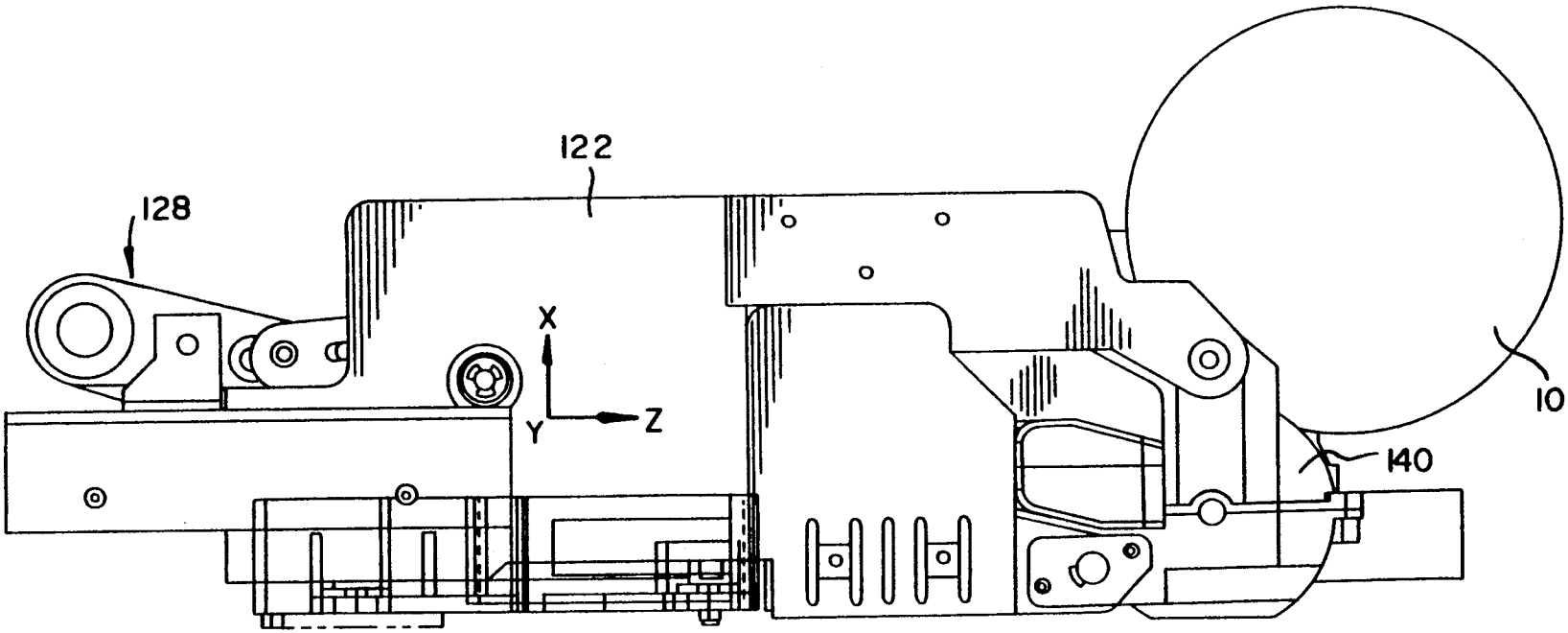

The photoconductive drum cartridge 140 is inserted in the chassis 122 with the chassis in the retracted position shown in FIG. 14. Once the cartridge is fully inserted and positioned with respect to laser housing 120, a handle 156 on over-center spring mechanism 128 is moved from the vertical position shown in FIG. 14 to a horizontal position shown, for example, in FIG. 13. Over-center spring mechanism 128 moves laser chassis 122 to the left thereby moving photoconductive drum 2 also to the left. As seen in FIGS. 4 and 8, the ends of photoconductive drum shaft 7 ride onto first and second positioning surfaces 95 and 97 of first and second positioning members 83 and 85, respectively. The shaft 7 rides on the positioning surfaces 95 and 97 until the photoconductive drum engages transfer drum 10, as shown in FIG. 4. At this position, the photoconductive drum 2 is controlled by the ends of shaft 7 resting on the first and second positioning surfaces 95 and 97 and the engagement with transfer drum 10. It is also supported by rollers 124 resting on guide plate 130. Engagement with transfer drum 10 is in the upper left hand portion of photoconductive drum 2, which engagement urges transfer drum 2 with a force that has a vector in the downward direction which maintains contact between photoconductive drum shaft 7 and the positioning surfaces 95 and 97.

Thus, the structure has first accurately mounted the photoconductive drum cartridge 140 with respect to laser 5 and then moved both the laser and the cartridge together to a position controlled by the photoconductive drum shaft to assure proper relationship with the transfer drum 10 and the development device 6.

FIG. 15 shows a cross-section of photoconductive drum cartridge 140 which illustrates, in addition to the elements previously discussed, the photoconductive drum cleaning device 12. Photoconductive drum cleaning device 12 includes a blade 13 which scrapes toner off the image surface 3. Entrance to the cleaning device is protected by a roller 14 which prevents the escape of toner that is cleaned by blade 3. Rotation of roller 14 and drum 2 tend to move toner cleaned by blade 3 to the right, as seen in FIG. 15, and down into a cleaned toner sump 9 positioned both over and around the opening 150 for the laser 5.

Figure 17:
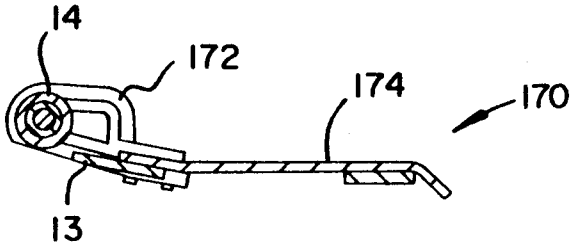
FIGS. 17 and 18 are a front section and a perspective view of a cleaning blade component.
Figure 18:
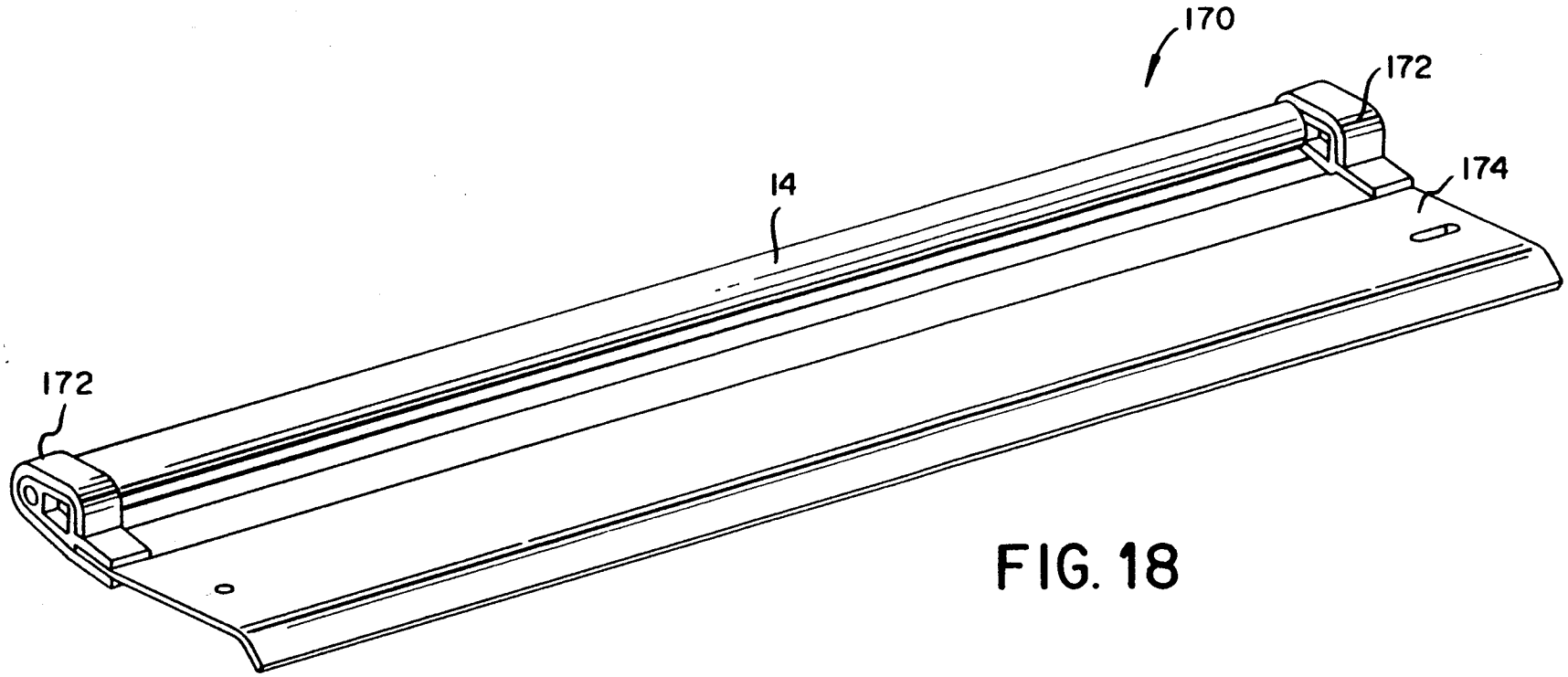

FIGS. 17 and 18 show an easily assembled cleaning component 170 which includes both roller 14 and blade 13. A pair of end pieces 172 define bearings for roller and are fixed to a support 174. Blade 13 is fixed to the underside of support 174. Component 170 is readily fixed to housing 138 by two fasteners shown in FIG. 15. The housing around roller 14 prevents buildup of toner on the roller and escape of toner upstream.

Figure 16:
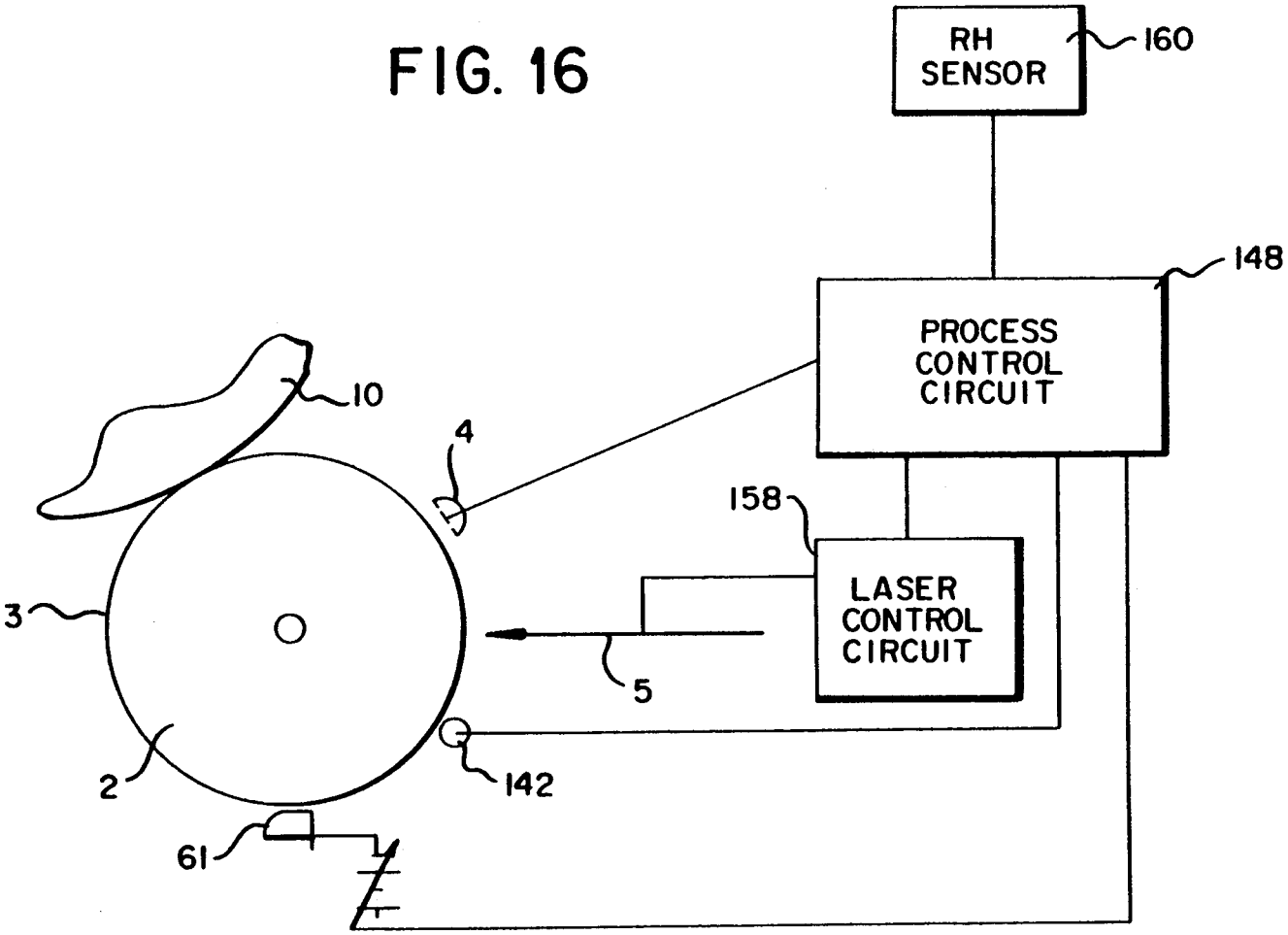
FIG. 16 is an electrical schematic illustrating process control circuit.

FIG. 16 shows a process control circuit 148 of a type generally well known in the art. More specifically, the process control circuit 148 receives inputs from a relative humidity sensor 160 and from an electrometer 142 and uses these inputs to control the charge deposited on image surface 3 by charging station 4, for example, by controlling a grid at charging station 4. The same inputs can be used to control the bias applied to applicator shell 61. The same inputs can be used further to control a laser control circuit 158 which controls the pixel-by-pixel intensity of laser 5.

A key to accurate process control, of course, is the inputs received. Electrometers are generally well known for use in process control, but have not heretofore been used with cartridge loaded photoconductive drums. The structure shown in FIGS. 10 and 14 for positioning the electrometer 142 with respect to image surface 3 makes process control usable in a cartridge loaded printer.

Carriage 31 also carries a bias source 76 for the applicator shells 61. Power for the carriage 31 is supplied by a flexible power cable 78.

FIG. 2 shows toner containers (herein sometimes called "bottles") 110, 111, 112 and 113 positioned on top of replenishers 63. These toner containers are positioned on the apparatus by a relatively untrained operator and opened. When opened, toner falls from the toner containers into a replenisher sump 180 (FIG. 3) forming part of the replenisher 63. Since the replenisher sump will not contain more than a small portion of the toner in the container, the container remains on the sump as part of the replenishing mechanism. The sumps themselves are shown in FIG. 3 minus a receiving structure for the containers that is shown, in part, in FIG. 2.

Figure 20:
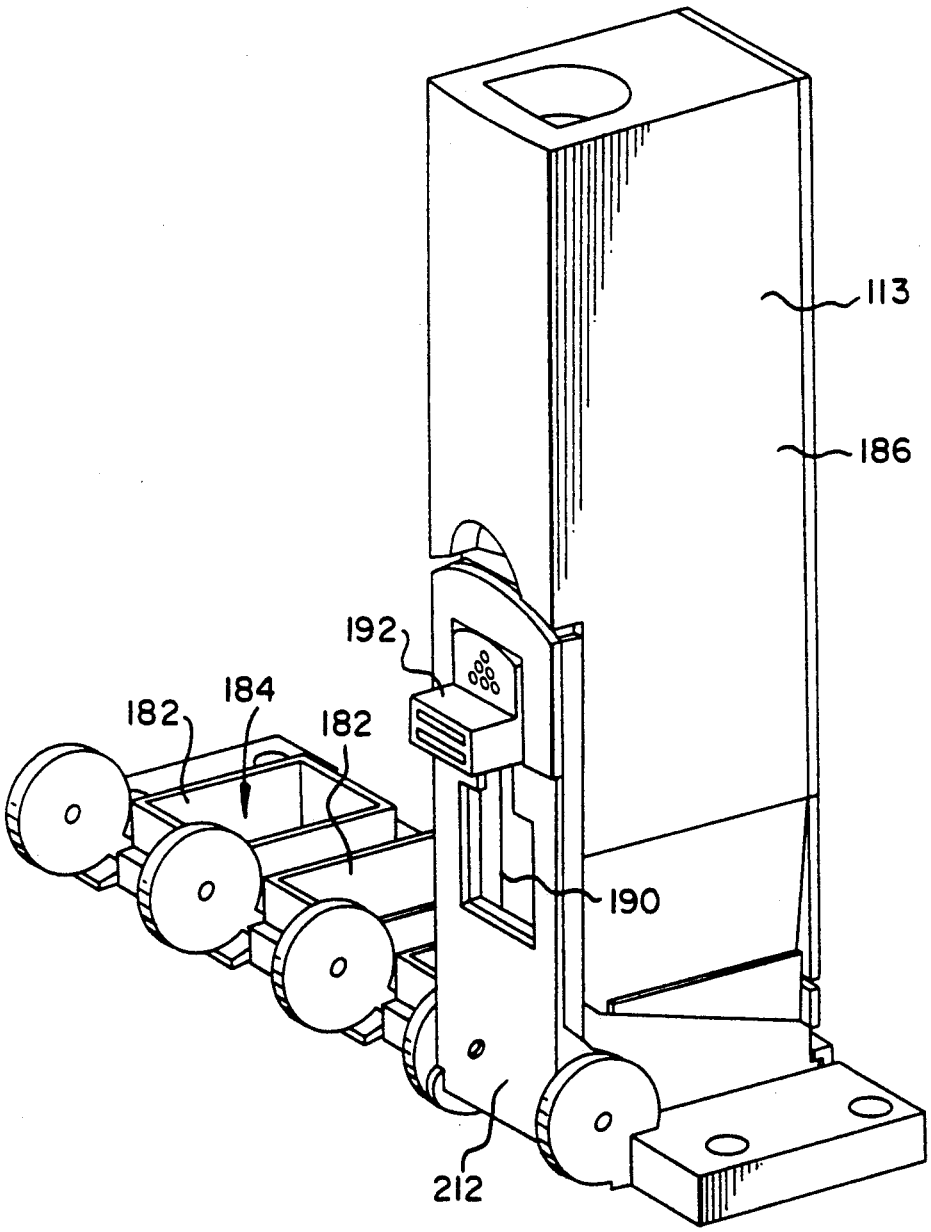
FIGS. 20, 24 and 25 are perspective views of the toner container receiving apparatus with one, three and no containers received, respectively.
Figure 21:
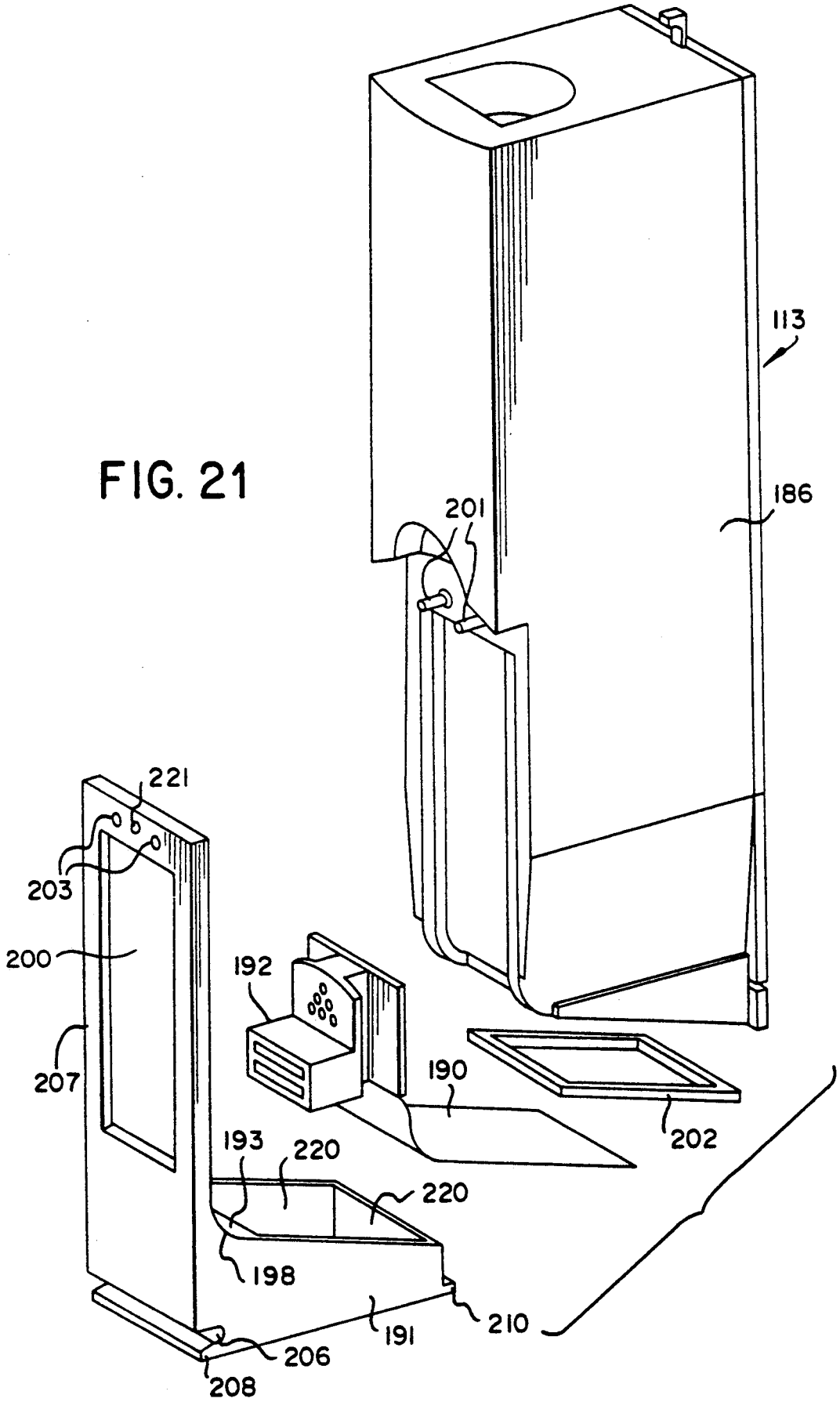
FIG. 21 is a perspective view of a toner container with four parts separated illustrating its assembly.
Figure 22:
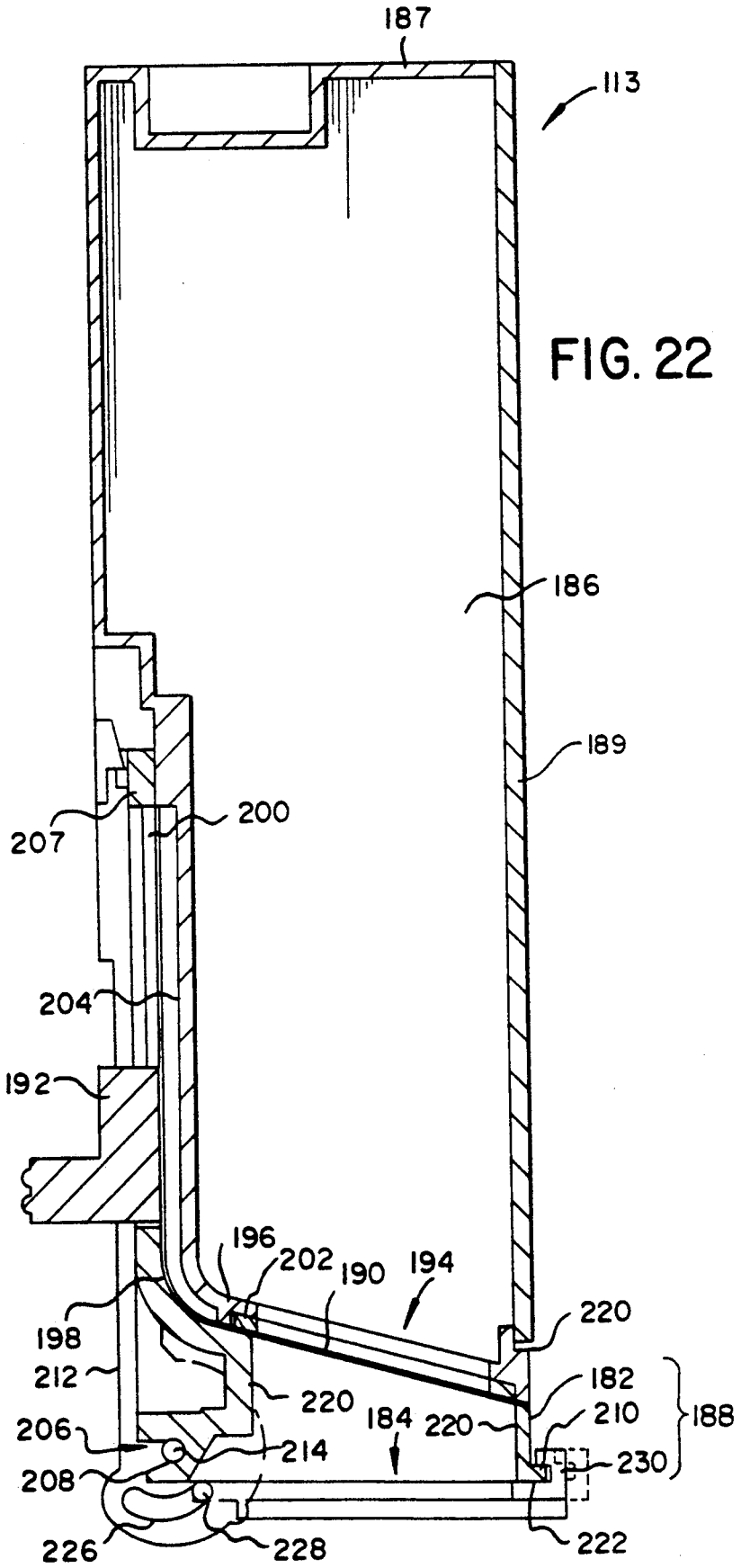
FIG. 22 is a side section of a toner container.

The containers or bottles and the receiving structure are more completely shown in FIGS. 19–25. Referring to FIG. 22, the bottle 113 includes a containing portion 186, a base 188, a cover 190, and a handle 192. The containing portion 186 and the base 188 are secured together or integrally formed to define an opening 194 through which toner can pass.

Cover 190 is secured across opening 194. It is made of a material, for example 0.010 inches thick polyester, which has appropriate stiffness and flexibility for this design, as will be explained. The cover 190 is supported for sliding movement by guide means which is partly defined by a curved guide surface 198. The handle 192 is fixed to cover 190 and protrudes through and is movable within a slot 200 in a vertical extension 207 of base 188. A compliant pad 202 is positioned in a slot 196 above cover 190 and extends slightly into the path of the cover to help prevent escape of toner from around the cover 190.

In operation, cover 190 is in its covering position, shown in FIG. 22, extending entirely across opening 194 underneath pad 202. Cover 190 extends around curved guide surface 198 to a vertical position adjacent a vertical exterior wall 204 of container portion 186 where it is attached to handle 192. When the operator raises handle 192, cover 190 slides around curved guide surface 198 to a position totally uncovering opening 194 at which position handle 192 is at the top of slot 200. The cover 190 is stiff enough that when handle 192 is returned to its lowered position, cover 190 is pushed in slot 196 back across opening 194 to its covering position though resisted somewhat by pad 202. Thus, the bottle has a removable and replaceable cover, which cover is stored in a position that does not protrude from the bottle. The cover itself is extremely thin compared to prior stiff covers. As such, it does not move toner substantially as it is returned into position but rather slices through any toner to its covering position. This allows the container to be removed with toner still in it, if desired. Though stiff enough for return movement, it is flexible enough to traverse a curved path to a convenient vertical position along wall 204.

The base 188 also includes structure for interfacing with a locking mechanism on the receiving apparatus. As seen in FIGS. 21 and 22, base 188 includes a groove 206 extending across the lower part of the front of base 188. Groove 206 defines a rib 208 at the bottom of the front of base 188. The rear of the base 188 has a rib 210 at the bottom facing in the opposite direction of rib 208.

The receiving apparatus is shown in FIGS. 20, 22, 24 and 25. According to FIG. 20, each receiving structure includes box-shaped upward extending vertical walls 182 which surround an opening 184 into the sump 180 (FIG. 3). A lever 212 is mounted for rotation about a axle 214. As shown best in FIG. 24, toner container 111 is inserted in the apparatus by first placing groove 206 around axle 214. Container 111 is then pushed backward, pivoting around axle 214 until it is positioned upright on the receiving structure. In this position, downwardly extending vertical, box-shaped walls 220 on the inside of base 188 fit over upwardly extending, box-shaped vertical walls 182 on the receiving structure and rib 210 at the rear of base 188 is seated on a surface 222 surrounding the upwardly extending walls 182. The mating box-shaped walls provide a tight enclosure preventing escape of toner.

In this position, the bottle is still closed and the handle 192 is in its lowered position. The lever 212 is rotated about axle 214 to a vertically upright position. A slot 216 in lever 212 has a wide portion 217 and a narrow portion 218. The wide portion fits around the handle 192 when the lever 212 is moved to its vertical position. A protruding detent 219 (FIGS. 24 and 25) enters a recessed detent 221 (FIG. 21) to hold the lever in its vertical position.

Figure 19:
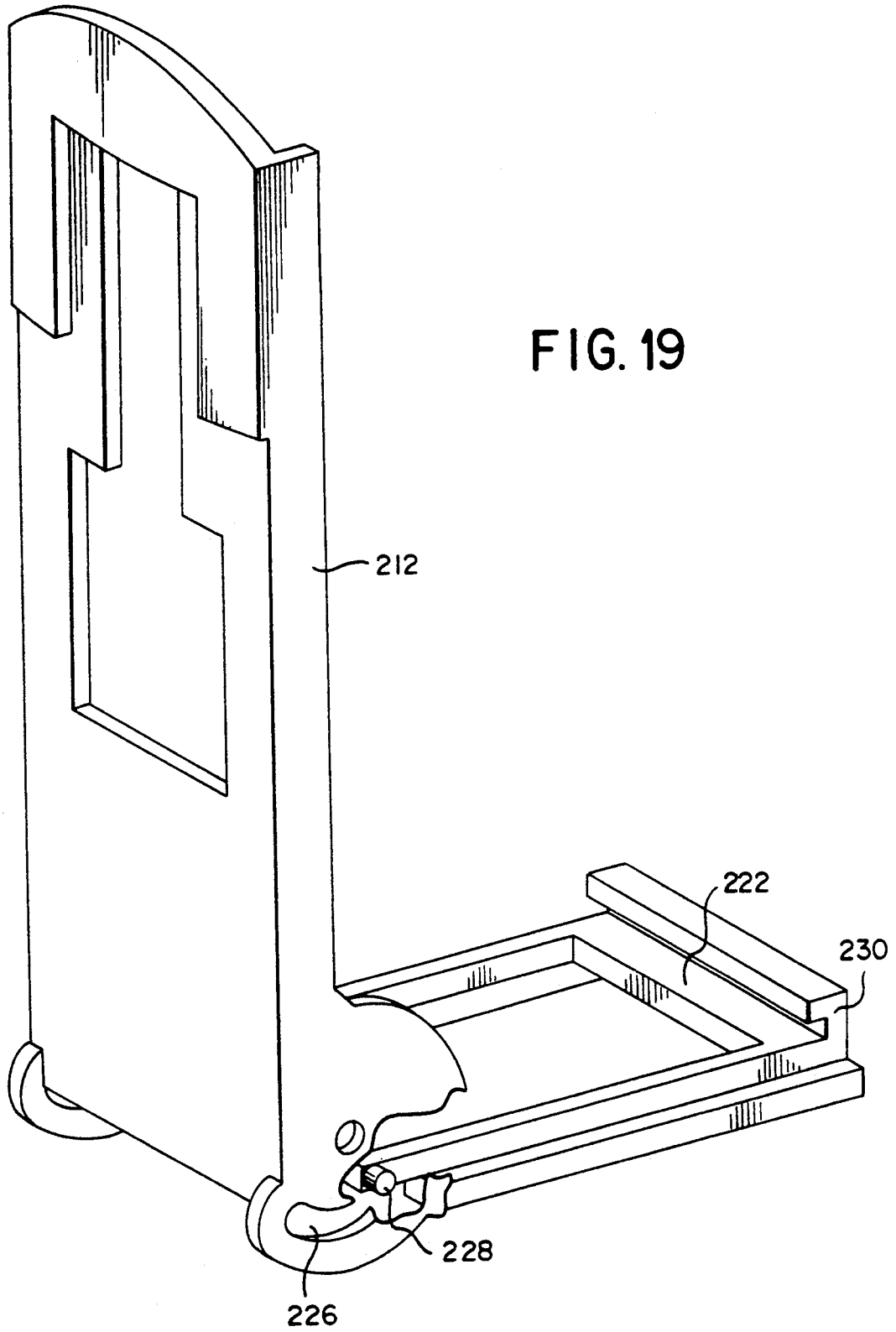
FIG. 19 is a perspective view of a locking structure for locking a toner container on a receiving apparatus.

Rotation of lever 212 to its vertical position rotates a cam surface 226 formed integrally with lever 212. A cam follower 228 moves to the left in cam surface 226, as seen in FIGS. 19 and 22. Cam follower 228 is attached to a locking detent 230 which is pulled over rib 210 to lock base 188 in position on the receiving apparatus.

As handle 192 is moved in an upward direction to open cover 190, it slides out of the wide portion 217 of slot 216 and into the narrow portion 218 to lock lever 212 in its vertical position. At this point, the cover is in its uncovering position and toner falls through opening 194 in the toner container and further through opening 184 into the sump. While the cover is open, the lever 212 is held by handle 192 in its vertical position, maintaining lock detent 230 in position holding base 188 on the receiving apparatus.

Removal of the container is the reverse of the above procedure. The handle 192 is moved to its lower position moving cover 190 to its covering position over opening 194. The lever 212 now can be moved to a horizontal position releasing lock detent 230 and allowing removal of the container. A finger hole 232 (FIG. 24) allows easy removal.

The cover 190 and the pad 202 provide an adequate enough seal that the usual adhesive paper seal, conventionally used for such toner containers, is not necessary. However, because of this, it is important that the handle 192 not be raised when the container is not on a sump. Accordingly, a releasable latch (not shown) preventing opening of cover 190 is preferably formed in vertical extension 207 or extending from wall 204. The latch is releasable by a protrusion (not shown) on lever 212 when lever 212 is raised to its vertical position.

Thus, this structure provides a container which is secured firmly to the receiving apparatus while having a tight interface between upward extending box-like walls 182 and downward extending box-like walls 220 to prevent the escape of toner. A cover is movable between covering and uncovering positions without protruding from the container where it can prevent closing of the door or the like. Further, moving the cover to its uncovering position secures the locking device on the base so that it cannot be unlocked without closing the cover.

Figure 23:
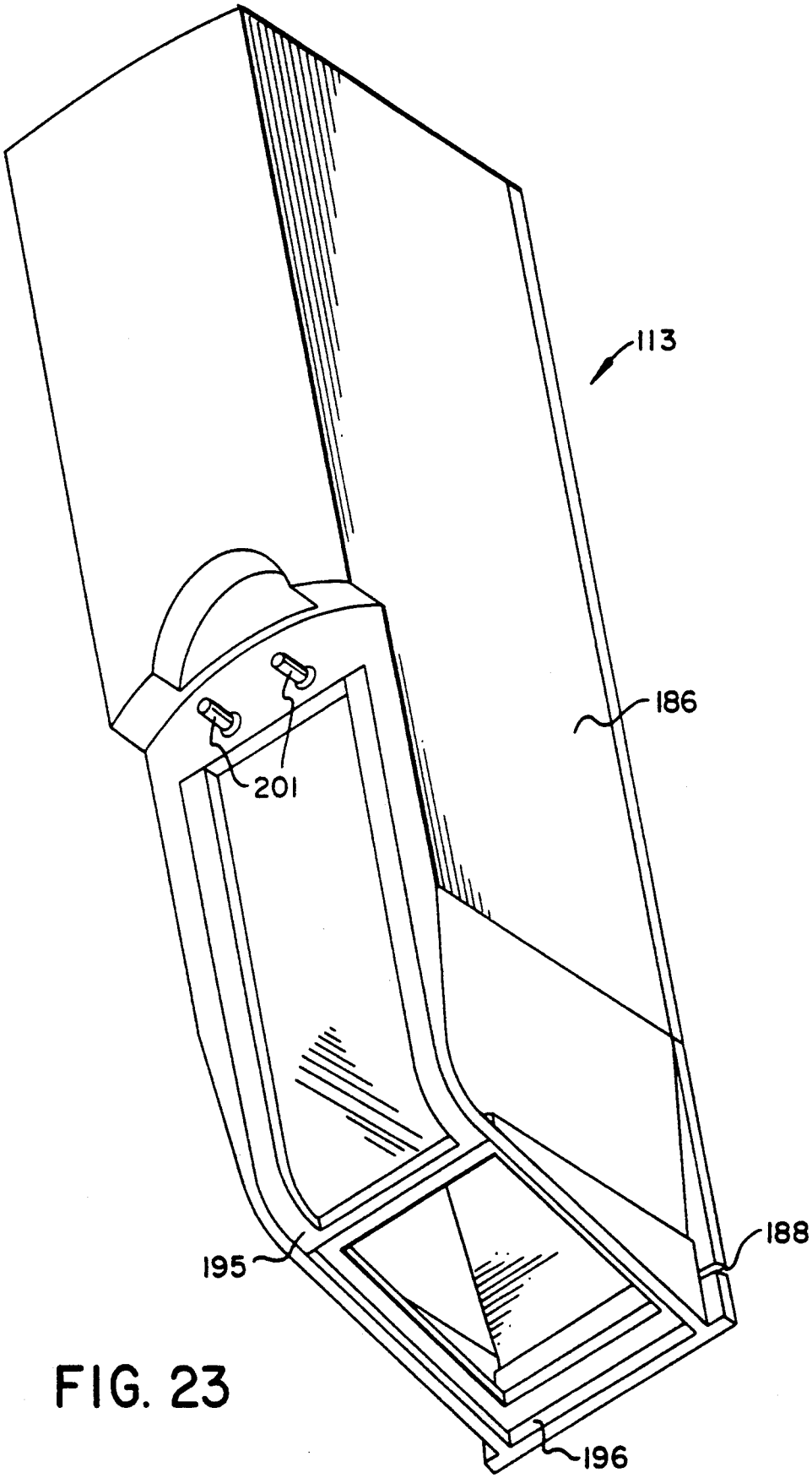
FIG. 23 is a bottom perspective view of a containing portion of a toner container.
Figure 24:
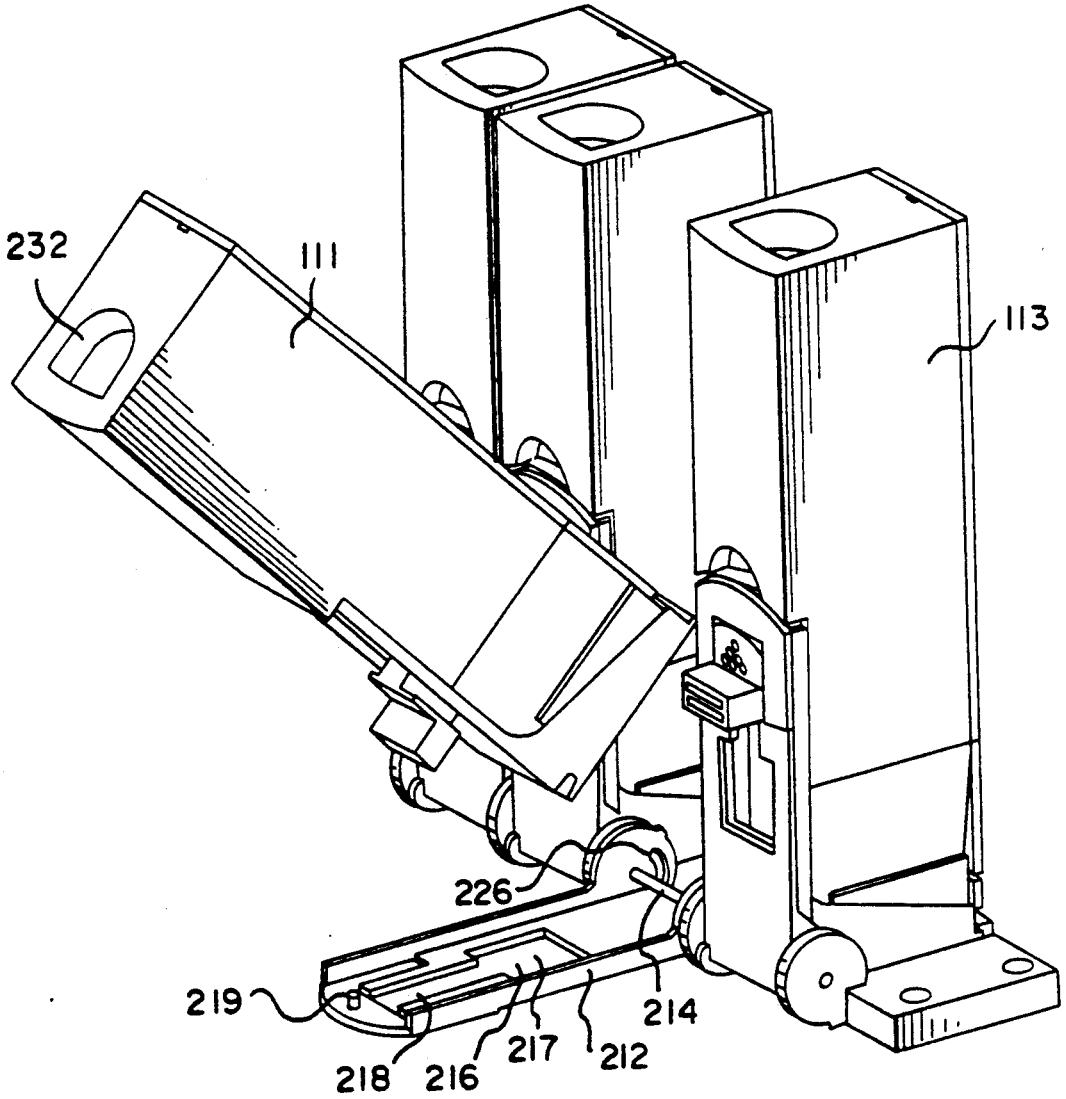

FIGS. 21-23 illustrate one approach for assembling container 113. Referring first to FIG. 22, the containing portion 186 can be formed in two parts including a primary containing piece 187 and a covering piece 189 which are heat or vibration welded together to form the containing portion 186. At the bottom of the containing portion 186 around opening 194 is the upper part of slot 196 (see also FIG. 23) into which is placed pad 202. Vertical extension 207 with slot 200 and curved guide 198, as well as ribs 208 and 210, are all defined by a bottom piece 191. Handle 192 is inserted in slot 200 in bottom piece 191 with cover 190 resting on an upper surface 193 of bottom piece 191. Upper surface 193 forms the bottom of slot 196 and guide surface 198.

A pair of protrusions 201 on containing portion 186 snap (or clearance) fit into holes 203 in bottom piece 191. The rear of surface 193 also snap fits into the rear of the bottom of containing portion 186 using conventional snap fitting structure with interlocking step features (not shown). After the snap fit, either or both of the connections can be heat welded, if necessary. Thus, the guide means for cover 190 is formed, in part, by surface 193 on bottom piece 191 and, in part, by a complimentary surface 195 (FIG. 23) of containing portion 186 and, in part, by pad 202 in slot 196.

Figure 25:
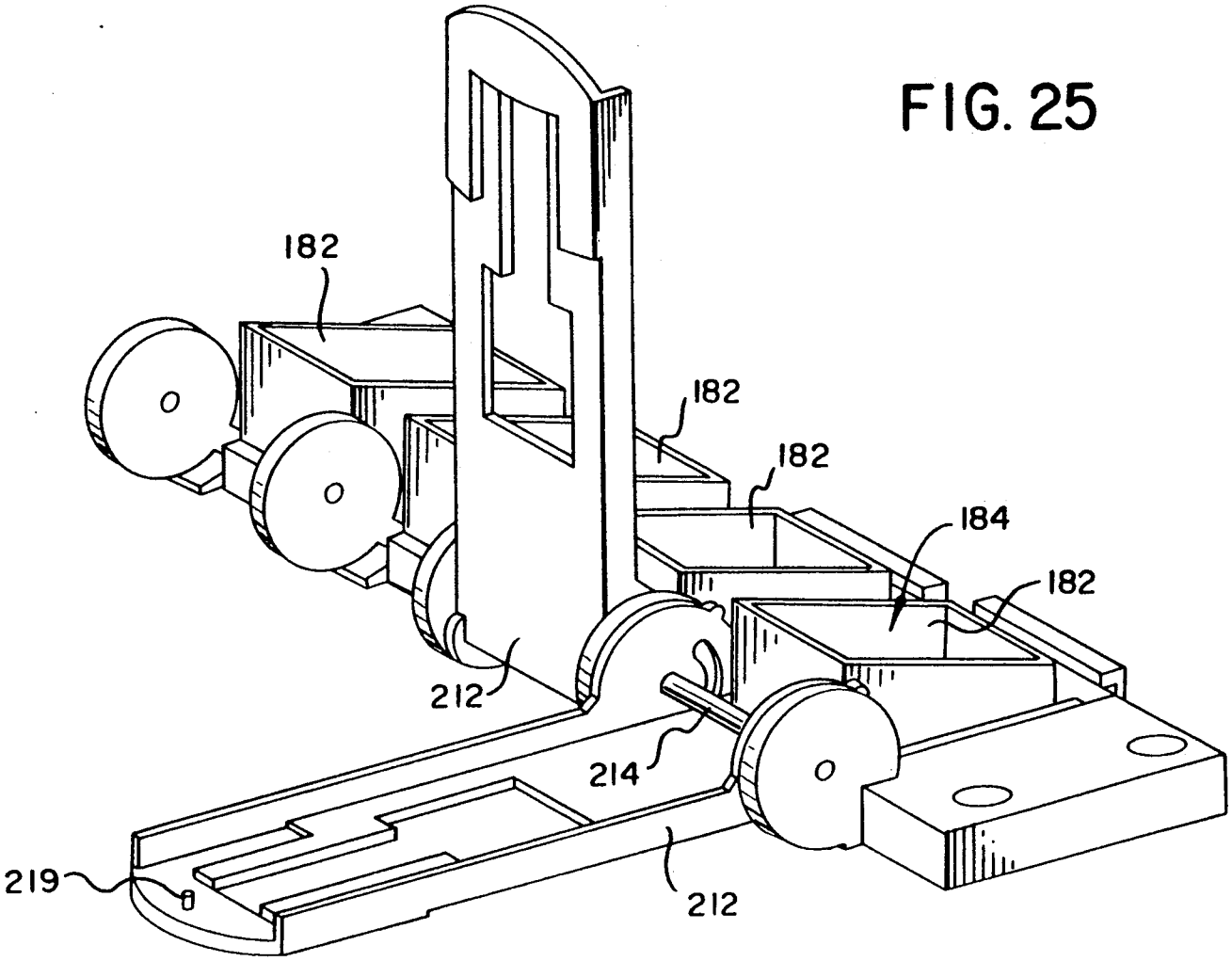

The container 113 is shown in FIG. 22 with a slanted guide means for cover 190 in its covering position. This is designed in this manner for convenience in manufacture. The portion of cover 190 covering opening 194 could be totally horizontal or tilted in a direction opposite that shown in FIG. 22. A thin flexible polyester or similar material can easily traverse a curved path through a 90° or greater arc. The upwardly extending walls 182 are shown in FIG. 25 with a slanted top to mate with the receiving walls 220 and the slanted cover 190 shown in FIG. 22. However, the walls 182 could have a horizontal top as shown in FIG. 20 with either the container shown in FIG. 22 or a container with a cover that has a horizontal covering position.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus comprising:

a transfer drum, an exposure means, a chassis for mounting said exposure means, said chassis including means for receiving an image member cartridge with the image member in such a received cartridge fixed with respect to said exposure means, means for supporting said chassis in said image forming apparatus for movement of said chassis and a received image member cartridge as a unit with respect to said transfer drum, and means for urging said chassis toward said transfer drum to cause engagement of an image member in the received image member cartridge with said transfer drum.

2. Image forming apparatus comprising:

a transfer drum mounted for rotation about an axis, a laser, a laser chassis for fixedly mounting said laser, said laser chassis including means for receiving a photoconductive drum cartridge of the type containing a photoconductive drum mounted on a shaft for rotation about an axis of revolution, said means for receiving said photoconductive drum cartridge including means for positioning said cartridge with respect to said laser, means for urging said laser chassis and a received cartridge as a unit toward said transfer drum to cause engagement of the photoconductive drum with said transfer drum, and means for maintaining the axes of revolution of said drums parallel when said drums are engaged.

3. Image forming apparatus according to claim 2 further including positioning surface means for engaging opposite ends of the shaft of a photoconductive drum of a received cartridge to control the movement of the laser chassis toward said transfer drum to maintain the axes of rotation of the drums parallel when the drums are engaged.

4. Image forming apparatus according to claim 3 wherein said surface means is generally horizontal and is fixed with respect to said transfer drum.

5. Image forming apparatus according to claim 4 wherein the engagement of the drums exerts a force on the photoconductive drum that has a vector which maintains contact between the surface means and the shaft of the photoconductive drum.

6. Image forming apparatus according to claim 3 further including means for supporting said laser chassis at one other point removed from said surface means.

7. Image forming apparatus according to claim 2 wherein said photoconductive drum cartridge is slidable into said laser chassis by movement generally parallel to the axis of rotation of the photoconductive drum and orthogonal to the movement of the chassis toward the transfer drum.

8. Image forming apparatus according to claim 1 wherein said means for urging said chassis includes an over-center spring.

* * * * *